US009058768B2

(12) United States Patent
Lee et al.

(10) Patent No.: US 9,058,768 B2
(45) Date of Patent: Jun. 16, 2015

(54) DISPLAY DEVICE AND ARRANGING METHOD FOR IMAGE DATA THEREOF

(75) Inventors: Seung-Woo Lee, Yongin (KR); An-Su Lee, Yongin (KR); Do-Youb Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 206 days.

(21) Appl. No.: 13/561,548

(22) Filed: Jul. 30, 2012

(65) Prior Publication Data

US 2013/0208021 A1 Aug. 15, 2013

(30) Foreign Application Priority Data

Feb. 10, 2012 (KR) ..... 10-2012-0013899

(51) Int. Cl.
*G09G 5/10* (2006.01)
*G09G 3/32* (2006.01)

(52) U.S. Cl.
CPC ..... *G09G 3/32* (2013.01)

(58) Field of Classification Search
USPC ..... 345/690
See application file for complete search history.

(56) References Cited

U.S. PATENT DOCUMENTS 6,608,642 B1 * 8/2003 Omae ..... 347/237
8,339,423 B2 * 12/2012 Tomizawa et al. ..... 345/690
8,810,612 B2 * 8/2014 Lee et al. ..... 345/690

FOREIGN PATENT DOCUMENTS

KR 10-2006-0010491 A 2/2006
KR 10-2006-0056791 A 5/2006
KR 10-2006-0065084 A 6/2006

* cited by examiner

*Primary Examiner* — Fred Tzeng
(74) *Attorney, Agent, or Firm* — Knobbe Martens Olson & Bear LLP

(57) ABSTRACT

A display device including a display panel having first pixels emitting light in a first field and second pixels emitting light in a second field is disclosed. According to one aspect, the display device includes a controller configured to extract first field data transmitted to the first pixels and second field data transmitted to the second pixels from input data, divide the first field data, insert black data between two neighboring first field data to generate first output data, divide the second field data, and insert black data between two neighboring second field data to generate second output data. The display device also includes a data driver configured to transmit a first data signal based on the first output data to the display panel in the first field and transmitting a second data signal based on the second output data to the display panel in the second field.

35 Claims, 22 Drawing Sheets

FIG.7

Data1

| | | | | | | | | | | | | |
|---|---|---|---|---|---|---|---|---|---|---|---|---|
| L1 | R11 | G11 | B11 | R12 | G12 | B12 | R13 | G13 | B13 | R14 | G14 | B14 |
| L2 | R21 | G21 | B21 | R22 | G22 | B22 | R23 | G23 | B23 | R24 | G24 | B24 |
| L3 | R31 | G31 | B31 | R32 | G32 | B32 | R33 | G33 | B33 | R34 | G34 | B34 |
| L4 | R41 | G41 | B41 | R42 | G42 | B42 | R43 | G43 | B43 | R44 | G44 | B44 |

FIG.8A

Data1-1(B)

| | | | | | | | | | |
|---|---|---|---|---|---|---|---|---|---|
| L1 | R11 | Black | B11 | Black | G12 | Black | R13 | Black | B13 | Black | G14 | Black |
| L2 | R21 | Black | B21 | Black | G22 | Black | R23 | Black | B23 | Black | G24 | Black |
| L3 | R31 | Black | B31 | Black | G32 | Black | R33 | Black | B33 | Black | G34 | Black |
| L4 | R41 | Black | B41 | Black | G42 | Black | R43 | Black | B43 | Black | G44 | Black |

First field (1SF)

FIG.8B

Data1-2(B)

| | | | | | | | | | | | |
|---|---|---|---|---|---|---|---|---|---|---|---|
| L1 | Black | G11 | Black | R12 | Black | B12 | Black | G13 | Black | R14 | Black | B14 |
| L2 | Black | G21 | Black | R22 | Black | B22 | Black | G23 | Black | R24 | Black | B24 |
| L3 | Black | G31 | Black | R32 | Black | B32 | Black | G33 | Black | R34 | Black | B34 |
| L4 | Black | G41 | Black | R42 | Black | B42 | Black | G43 | Black | R44 | Black | B44 |

Second field (2SF)

FIG.15A

Data1-1

First field (1SF)

| | | | | | | |
|---|---|---|---|---|---|---|
| L1 | R11 | B11 | G12 | R13 | B13 | G14 |
| L2 | R21 | B21 | G22 | R23 | B23 | G24 |
| L3 | R31 | B31 | G32 | R33 | B33 | G34 |
| L4 | R41 | B41 | G42 | R43 | B43 | G44 |

FIG.15B

Data1-2

Second field (2SF)

| | | | | | | |
|---|---|---|---|---|---|---|
| L1 | G11 | R12 | B12 | G13 | R14 | B14 |
| L2 | G21 | R22 | B22 | G23 | R24 | B24 |
| L3 | G31 | R32 | B32 | G33 | R34 | B34 |
| L4 | G41 | R42 | B42 | G43 | R44 | B44 |

FIG.18A

| | | | | | | | |
|---|---|---|---|---|---|---|---|
| First field (1SF) | L1 | R11 | B11 | Black | R13 | B13 | Black |
| | L2 | Black | Black | G22 | Black | Black | G24 |
| | L3 | R31 | B31 | Black | R33 | B33 | Black |
| | L4 | Black | Black | G42 | Black | Black | G44 |

FIG.18B

| | | | | | | | |
|---|---|---|---|---|---|---|---|
| Second field (2SF) | L1 | G11 | Black | Black | G13 | Black | Black |
| | L2 | Black | R22 | B22 | Black | R24 | B24 |
| | L3 | G31 | Black | Black | G33 | Black | Black |
| | L4 | Black | R42 | B42 | Black | R44 | B44 |

DISPLAY DEVICE AND ARRANGING METHOD FOR IMAGE DATA THEREOF

CROSS-REFERENCE TO RELATED APPLICATIONS

This application claims priority to and the benefit of Korean Patent Application No. 10-2012-0013899 filed in the Korean Intellectual Property Office on Feb. 10, 2012, the entire contents of which are incorporated herein by reference.

BACKGROUND

1. Field

The disclosed technology generally relates to a display device and a method of arranging image data thereof. More particularly, the disclosed technology relates to a method of arranging memory data for reducing color division in time-division driving and a display device using the same.

2. Description of the Related Technology

An active matrix display device displays various colors by a brightness combination of an R pixel representing light of a red color (hereinafter referred to as "R"), a G pixel representing light of a green color (hereinafter referred to as "G"), and a B pixel representing a light of a blue color (hereinafter referred to as "B").

In a display panel of the display device, the R, G, and B pixels are continuously disposed in a row direction, and are respectively connected to the data lines. In driving a conventional display panel, many integrated circuits to drive data lines are used such that wiring connection schemes for the pixel are complicated, resulting in a reduced aperture ratio for the display panel.

A display panel having a time-division driving scheme in which a pixel connected to one data line includes at least one light emitting element and receives a data signal at different times among one frame period for emitting light has been developed in order to reduce the complexity of the wiring scheme for driving the display panel.

In a time-division scheme, a driving time is divided into sections to form time slots to write data to the display, and each time slot is independently used by each user. The time-division driving scheme in the display device is a method in which all pixels of the display device are divided into at least two groups, and one frame period is divided into at least two fields. As a result, the pixels of a group corresponding to each field emit light at the same time.

The display device according to the time-division driving method divides the image of one frame into at least two images to be displayed and the input data (hereinafter, the input data of one frame) representing the image of one frame is divided for each field (or pixel group) to output the image data regardless of the structure of the display panel, which can be a regular display panel or a time division driving scheme display panel. The complete image is expressed at one time based on the arrangement of the data that is stored in a memory.

However, in a method of dividing all pixels into at least two groups, a special image becomes a disruptive pattern for the display device of the time-division driving method. The disruptive pattern generally corresponds to a display pattern that generates a screen failure phenomenon when being displayed in the display device according to the time-division driving method. One example of the screen failure phenomenon is a false contour.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

According to some embodiments, a memory arranging method of image data of a display device is disclosed to reduce the risk of a screen failure phenomenon due to a disruptive pattern when writing an image pattern in a time-division driving method of a display device.

According to one aspect, a display device is disclosed. The display device includes a display panel including a plurality of first pixels emitting light in a first field and a plurality of second pixels emitting light emitting in a second field, and a controller configured to extract a plurality of first field data transmitted to a plurality of first pixels in the first field and a plurality of second field data transmitted to a plurality of second pixels in the second field from input data, divide a plurality of first field data as a line unit, insert black data between two neighboring first field data among a plurality of first field data of one line unit so as to generate first output data, divide a plurality of second field data as a line unit, insert black data between two neighboring second field data among a plurality of second field data of one line unit so as to generate second output data. The display device also includes a data driver configured to transmit a first data signal according to the first output data to the display panel in the first field and transmit a second data signal according to the second output data to the display panel in the second field.

According to one aspect, a display device is disclosed. The display device includes a display panel including a plurality of pixels including a first light emitting element emitting light in a first field and a second light emitting element emitting light in a second field, and a controller configured to extract a plurality of first field data transmitted to a plurality of first light emitting elements in the first field and a plurality of second field data transmitted to a plurality of second light emitting elements in a second field from input data. The display device also includes a data driver configured to transmit the first data signal according to a plurality of first field data to the display panel in the first field and transmit the second data signal according to a plurality of second field data to the display panel in the second field. The first field data is respectively transmitted to the first light emitting elements included in three pixels that are continuous along one direction such that at least three color data corresponding to light of different colors are repeatedly arranged, and the second field data is respectively transmitted to the second light emitting elements included in three pixels that are continuous along one direction such that at least three color data corresponding to the light of different colors are repeatedly arranged.

According to one aspect, a method of arranging image data of a display device in which one frame is driven in a first field and a second field is disclosed. The method includes storing input data to a data memory, dividing the stored input data into a plurality of first field data transmitted to a plurality of first elements emitting light in the first field and a plurality of second field data transmitted to a plurality of second elements emitting light in the second field, generating a plurality of first field data and a plurality of second field data as first output data and second output data, transmitting a first data signal based on the first output data to a plurality of first elements in the first field, and transmitting a second data signal based on the second output data to a plurality of second elements in the second field.

BRIEF DESCRIPTION OF THE DRAWINGS

FIG. 7 is a view of an input data map of a display device.

FIG. 8A and FIG. 8B are views of a data map for each field according to a memory arranging method of image data according to some embodiments.

FIG. 15A and FIG. 15B are views of a data map for each field according to a memory arranging method of image data according to some embodiments.

FIG. 18A and FIG. 18B are views showing an image data map for each field extracted from input data according to a 1 dot pattern by a memory arranging method of image data according to some embodiments.

DETAILED DESCRIPTION OF CERTAIN INVENTIVE EMBODIMENTS

Figure 1:
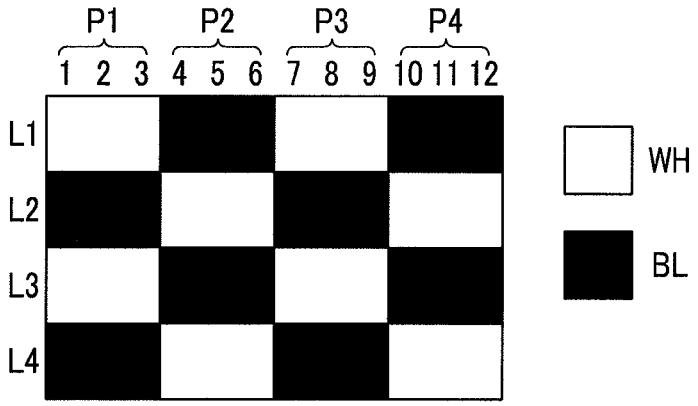
FIG. 1 is a view of a 1 dot pattern structure displayed in a display panel as a pixel unit.

The present invention will be described more fully hereinafter with reference to the accompanying drawings, in which some embodiments of the invention are shown. The described embodiments may be modified in various different ways, all without departing from the spirit or scope of the present invention.

Constituent elements having the same structures throughout the embodiments are denoted by the same reference numerals and are described in a first embodiment. In the other embodiments, only constituent elements other than the same constituent elements will be described.

In addition, parts not related to the description are omitted for clear description of the disclosed embodiments, and like reference numerals designate like elements and similar constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

An image displayed in a display panel of a display device may have various pattern shapes, and FIG. 1 is an example of a 1×1 dot pattern (hereinafter, a 1 dot pattern). The 1 dot pattern is a pattern in which a white color and a black color are crossed and arranged with the same ratio in an up and down direction and in a right and left direction. However, the 1 dot pattern is not limited to repetition image realization of a color as shown in FIG. 1.

In the 1 dot pattern, a repetition unit of a full white image and a full black image is defined by a dot region. The dot region alternately displays the color in the up and down direction and the right and left direction.

In FIG. 1, one pixel (of P1, P2, P3, and P4) including three sub-pixels respectively displaying each color of RGB is the 1 dot region, however it is not limited thereto. According to another shape, the 1 dot region may be a group including at least one pixel alternately displaying different luminance colors in up/down and right/left directions, for example, the white image and the black image.

Figure 2:
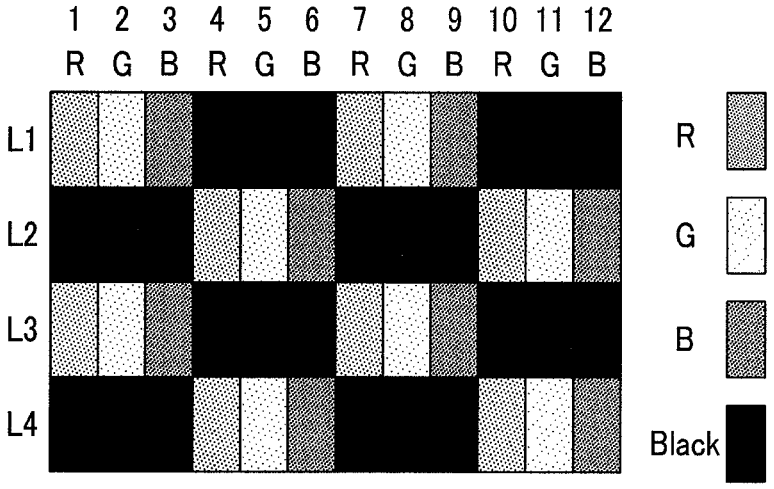
FIG. 2 is a view of the pattern of FIG. 1 as a sub-pixel unit.

FIG. 2 is a view of the pattern of FIG. 1 as a sub-pixel unit. The dot region forming the 1 dot pattern in FIG. 1 is one pixel including the RGB sub-pixels. Accordingly, in FIG. 2, the first dot region of a first pixel line L1 includes an R sub-pixel (a first column sub-pixel), a G sub-pixel (a second column sub-pixel), and a B sub-pixel (a third sub-pixel), and emits light to display a white image. Also, the second dot region neighboring in the right and left direction (a horizontal direction) includes the R sub-pixel (a fourth sub-pixel), the G sub-pixel (a fifth sub-pixel), and the B sub-pixel (a sixth sub-pixel), and each sub-pixel is not driven to not be emitted, thereby displaying a black image. For convenience, the meaning of displaying the black image may include a conception that the pixel is not driven for the non-light emitting and that the black data is input to display the image thereof. The RGB sub-pixels included in the dot region neighboring each other in the horizontal direction repeat the light emitting and the non-light emitting to display the white image and the black image.

Likewise, the dot region (the first pixel of the second pixel line) neighboring in the up and down direction (the vertical direction) with reference to the first dot region of first pixel line L1 includes the R sub-pixel (the first column sub-pixel), the G sub-pixel (the second column sub-pixel), and the B sub-pixel (the third column sub-pixel), and the RGB sub-pixels display the black image for the non-light emitting. The RGB sub-pixels included in the dot regions that are continuous in the vertical direction repeat the light emitting and the non-light emitting to display the white image and the black image.

Figure 3A:
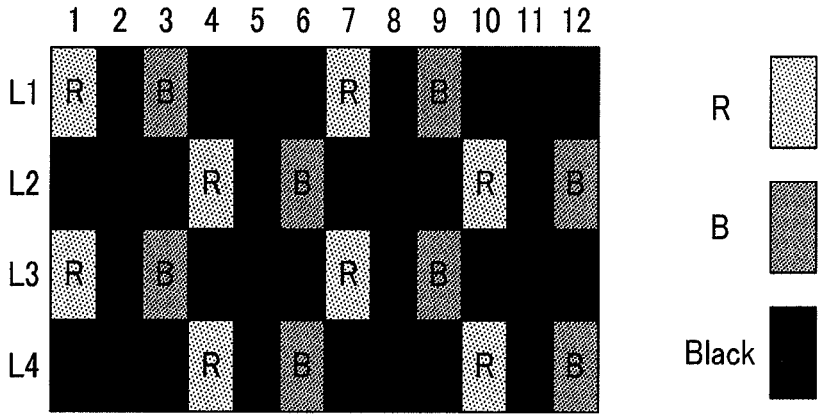
FIG. 3A and FIG. 3B are views of a light emitting shape of a sub-pixel for each field of one frame in a display device applied with a conventional data arranging method when realizing the pattern of FIG. 1.
Figure 3B:
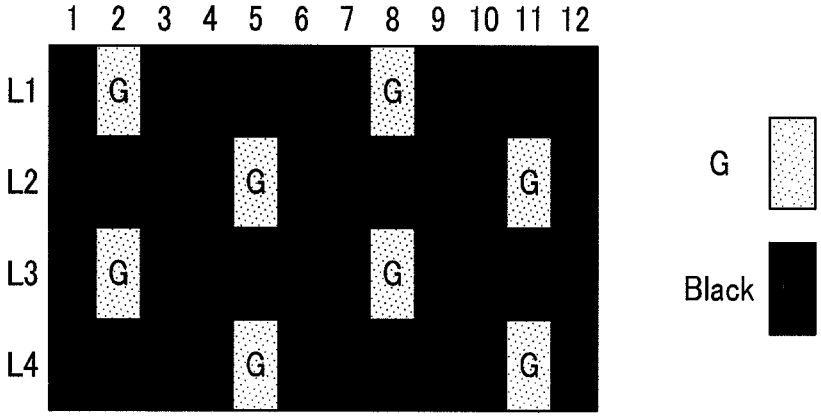

FIG. 3A and FIG. 3B are views of a light emitting shape of a sub-pixel for each field of one frame in a display device applied with a conventional data arranging method when realizing the pattern of FIG. 1. That is, when the data for displaying the 1 dot pattern of FIG. 1 is input and the image is the time-division driving image, FIG. 3A is a light emitting pattern in the first field and FIG. 3B is the light emitting pattern in the second field.

When all pixels of the display panel are divided into at least two groups and one frame is divided into at least two fields, and the pixels of the group corresponding to each field emit the light corresponding to the input data, FIG. 3A and FIG. 3B show the patterns of which the light is emitted when inputting the image of the 1 dot pattern of FIG. 1.

In FIG. 3A, the R sub-pixels and the B sub-pixels included in a plurality of dot regions displaying the white image emit the light in the first field such that the image of a pink color of which the red and the blue are mixed is displayed. A plurality of dot regions representing the remaining black image respectively display the black image as it is.

Meanwhile, in FIG. 3B, the G sub-pixels respectively included in a plurality of dot regions displaying the white image emits the light in the second field such that the image of the green is displayed. Also, a plurality of the remaining dot regions representing the black image display the black image as it is.

As described above, among the dot regions of the display panel, the dot regions emitting the light display the pink-based image in the first field and the green image in the second field, and thereby the color division is generated if the first field and the second field are temporary divided and driven. That is, the green color having higher luminance level than that of the red color and the blue color is displayed for each field such that the data image of the 1 dot pattern is experienced as serious color division for a user.

According to some embodiments, an arranging method of input data is differentiated to reduce and to remove color division in the 1 dot pattern.

Figure 4:
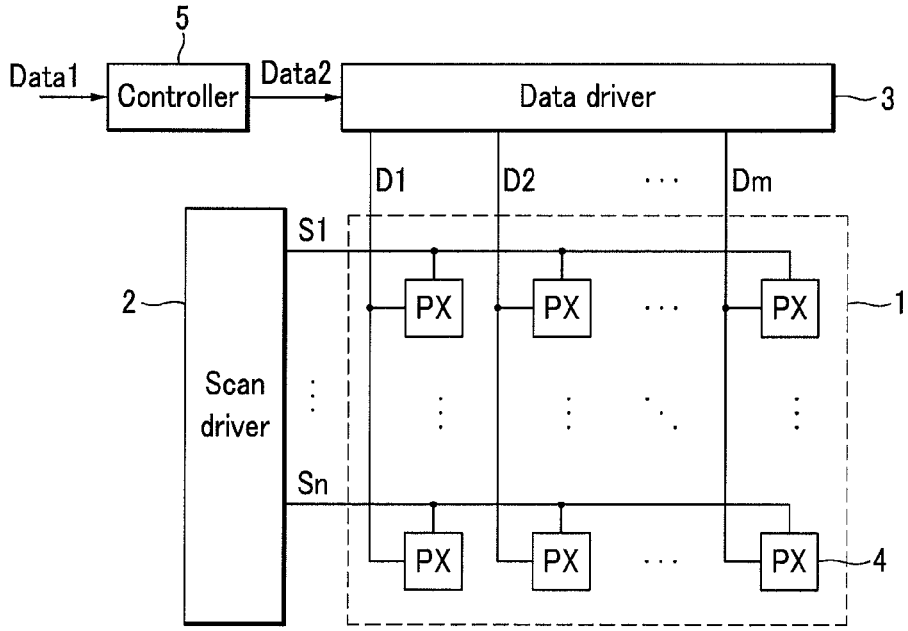
FIG. 4 is a block diagram of a display device according to some embodiments.

FIG. 4 is a block diagram of a display device according to some embodiments.

Referring to FIG. 4, the display device includes a display panel 1, a scan driver 2, a data driver 3, and a controller 5.

The display panel 1 is a general display panel including a plurality of pixels PX having one light emitting element. According to some embodiments, each pixel PX of the display panel 1 includes one light emitting element displaying predetermined R, G, and B colors according to a field driven by the time-division driving during one frame.

A plurality of the pixels included in the display panel 1 may be divided into a pixel group including a plurality of pixels emitting light in a predetermined field among one frame. For example, when being divided into two fields and driven with the time-division method, a plurality of pixels of the display panel 1 may be divided into the first pixel group including a plurality of first pixels emitting the light in the first field and the second pixel group including a plurality of second pixels emitting the light in the second field.

A plurality of pixels are respectively connected to a corresponding scan line among a plurality of scan lines S1-Sn extending in a row direction and a corresponding data line among a plurality of data lines D1-Dm extending in a column direction. For example, the pixel region defined by the last (n-th) scan line Sn among a plurality of scan lines connected to the display panel and the last (m-th) data line Dm among a plurality of data lines connected to the display panel includes the pixel 4.

Also, although not shown in FIG. 4, a plurality of pixels included in the display panel 1 are connected to a power wire supplying driving power, and the power wire is connected to a driving power supply unit.

The scan driver 2 sequentially applies the scan signal to a plurality of scan lines S1-Sn for the pixel connected to the corresponding scan line to be input with the data signal. The scan driver 2 sequentially transmits a plurality of scan signals transmitted to all pixels of the display panel 1 for each field according to the time-division driving.

The data driver 3 applies the data signal through the corresponding data line among a plurality of data lines D1-Dm with the pixel activated by the scan signal whenever the scan signal is sequentially applied. The data signal corresponds to a data signal according to output data that is arranged and transmitted in the controller 5 for each field. The light emitting element of each pixel emits the light with the driving current according to the applied data signal to display the image.

The controller 5 generates an output data Data2 applied for each field from the input data Data1 and transmits it to the data driver 3 to realize the image pattern emitting the light every field of one frame in the time-division driving according to some embodiments. Here, the output data Data2 includes the data transmitted in the first field and the second field forming one frame.

At this time, the output data Data2 arranged for each field is data that is generated by extracting data suitable for each field therefrom and using it after storing input data Data1. For example, the controller 5 receives the input data Data1 from the outside to extract a plurality of first field data transmitted to a plurality of first pixels of the display panel 1 emitting the light in the first field and a plurality of second field data transmitted to a plurality of second pixels of the display panel 1 emitting the light in the second field.

A plurality of first field data is divided as a line unit, and black data are inserted between two neighboring first field data among a plurality of first field data for each line unit to generate the first output data. Likewise, a plurality of second field data are divided as the line unit, and the black data is inserted between two neighboring second field data among a plurality of second field data for each line unit to generate the second output data.

The first output data and the second output data generated in the controller 5 are transmitted to the data driver 3. Thus, the data driver 3 generates the first data signal corresponding to the first output data and transmits it to a plurality of first pixels corresponding to the first field. Also, it generates the second data signal corresponding to the second output data to transmit it to a plurality of second pixels corresponding to the second field.

Accordingly, the controller 5 may further include an additional data storing unit storing the input data and the data arranged for each field.

Figure 5:
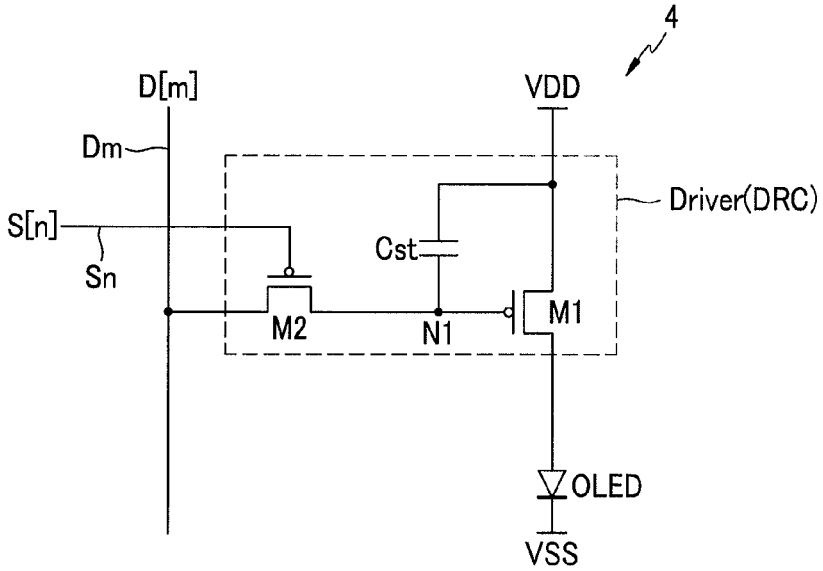
FIG. 5 is a circuit diagram of a pixel structure of the display device of FIG. 4.

FIG. 5 is a circuit diagram of a pixel structure of the display device of FIG. 4. For example, FIG. 5 illustrates a circuit diagram of the pixel 4 formed in the region where the n-th scan line Sn and the m-th data line Dm are crossed in the display panel 1 of FIG. 4.

The pixel 4 includes one driver DRC and an organic light emitting diode (OLED) emitting the light with the driving current according to the corresponding data signal by the activation of the driver. The organic light emitting diode (OLED) emits the light according to the data signal in the corresponding field among one frame according to the pixel group including the corresponding pixel 4.

The driver DRC of the pixel 4 includes a driving transistor M1, a switching transistor M2, and a capacitor Cst. Also, the organic light emitting diode (OLED) is connected to the drain electrode of the driving transistor M1.

The circuit structure of the pixel of FIG. 5 may be formed by using various circuit elements. Also, in the circuit diagram of FIG. 5, the transistor is a PMOS transistor, however it is not limited thereto.

For example, the driving transistor M1 as the transistor to drive the organic light emitting diode (OLED) includes a source electrode connected to the first power VDD supplying the first power source voltage, a gate electrode connected to the first node N1, and a drain electrode connected to an anode of the organic light emitting diode (OLED). The driving transistor M1 controls the driving current flowing to the organic light emitting diode (OLED) by the voltage difference applied between the gate electrode and the source electrode.

The switching transistor M2 is a transistor selecting the pixel 4 in response to the scan signal S[n] to activate the driver DRC. The switching transistor M2 includes the source electrode connected to the corresponding data line Dm, the gate electrode connected to the corresponding scan line Sn, and the drain electrode connected to the first node N1. If the switching transistor M2 is turned on in response to the scan signal S[n] supplied through the scan line Sn, the corresponding data signal D[m]) is transmitted through the data line Dm such that the data voltage according thereto is applied to the first node N1. Accordingly, the voltage of the gate electrode of the driving transistor M1 becomes the data voltage.

The capacitor Cst is connected between the first node N1 and the source electrode of the driving transistor M1, and at this time, the capacitor Cst includes a first electrode connected to the first node N1 and a second electrode connected to the source electrode of the driving transistor M1. The capacitor Cst stores a voltage according to a voltage difference applied to both electrodes, and if the data voltage transmitted through the activation of the driver DRC is applied to the first electrode, a voltage corresponding to the difference along with the first power source voltage applied to the second electrode is stored. Thus, the driving transistor M1 generates the driving current according to the corresponding voltage and transfers it to the organic light emitting diode (OLED).

A color arranging pattern and a data arranging method according to the time-division driving of the display panel including a plurality of pixels in a matrix form according to the embodiment shown in FIG. 5 will be described with reference to FIG. 6 to FIG. 11.

Figure 6:
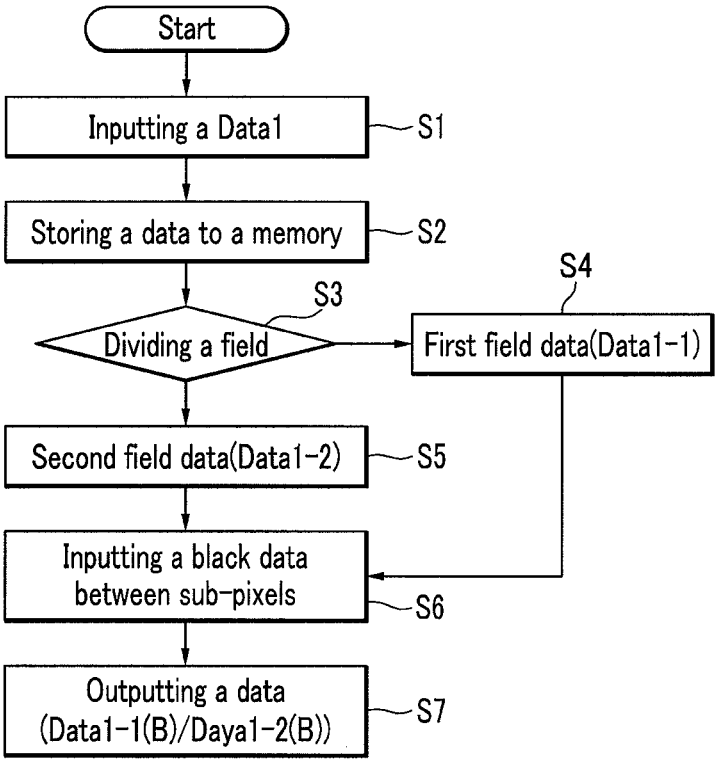
FIG. 6 is a flowchart of an arranging method of image data in time-division driving of the display device according to some embodiments of FIG. 4 and FIG. 5.

FIG. 6 is a flowchart of an arranging method of image data in time-division driving of the display device according to some embodiments of FIG. 4 and FIG. 5.

Firstly, the input data Data1 from outside the display device is transmitted to the controller of the display device (S1). The display device, according to some embodiments, relates to the data arranging processing and the management thereof to prevent the color division due to the time-division driving method when displaying the image corresponding to the input data input from the outside such that the data signal Data1 input in the step S1 is stored to a data memory under the characteristic of the time-division driving (S2). For example, when driving one frame at 60 Hz, the input data at 60 Hz can be stored and the data can be output corresponding to a field division number of the frame. According to some embodiments, if one frame is divided into two fields, the output data can be transmitted at 120 Hz two times for each field per frame. In this case, the controller may generate the output data Data2 corresponding to two fields from the input data.

In the step S2, the controller outputs the field data corresponding to the divided field per frame from the input data Data1 stored to the data memory, and at this time, whether the corresponding data is included in any field is queried (S3). When being divided into two fields, if the data is included in the first field, the data is output as the first field data Data1-1 in the step S4. Also, if the data is included in the second field, the data is output as the second field data Data1-2 in the step S5.

The field data output in the steps S4 and S5 are rearranged by respectively inserting the black data between the field data in the step S6. That is, after the first field data and the second field data are respectively extracted, the black data applied to the sub-pixels positioned between the sub-pixels emitting the light according to the corresponding field data is input and arranged.

Accordingly, in the step S7, output data Data1-1(B) and Data1-2(B) are generated with the state that the black data is inserted and arranged to the field data applied corresponding to each field. That is, the output data that is finally generated in the controller and is output to the data driver includes the first output data Data1-1(B) including the image information of the first field and the second output data Data1-2(B) including the image information of the second field.

Resultantly, the input data Data1 for one frame is totally transmitted and input, however, when being output from the controller to the data driver, the output data Data1-1(B) and Data1-2(B) for each field are output with the state that the black data is inserted and arranged through the process as shown in FIG. 6.

FIG. 7 is a view of an input data map of a display device. For example, FIG. 7 displays the data input to the sub-pixels corresponding to a portion of the region of the display panel to easily display an output data map arranged according to the arranging method of the data by the embodiment of FIG. 6.

Particularly, FIG. 7 shows the arrangement of the data related to a predetermined position of each sub-pixel of a plurality of pixels included from the first pixel line L1 to the fourth pixel line L4 and transmitted to the sub-pixel.

One organic light emitting diode (OLED) is formed for every sub-pixel of the display panel 1 of the display device according to some embodiments such that the data transmitted from the data driver 3 are sequentially arranged with the sequence of the R sub-pixel emitted with a red color, the G sub-pixel emitted with a green color, and the B sub-pixel emitted with a blue color for each line. In the embodiment of FIG. 7, the data transmitted to each sub-pixel may be divided and displayed according to the corresponding line of the sub-pixel emitting the color—the corresponding row of the pixel including the sub-pixels. For example, R23 is red signal data transmitted to the sub-pixel included in the third pixel of second pixel line L2 and emitting the red color.

FIG. 8A and FIG. 8B show the output data for each field rearranged through the process of FIG. 6 according to the time-division driving, according to some embodiments, from the input data Data1 including the image information and arranged as shown FIG. 7.

That is, FIG. 8A is the first field data Data1-1(B) map output to the first pixels corresponding to the first pixel group of the display panel in the first field 1SF, and FIG. 8B is the second field data Data1-2(B) map output to the second pixels corresponding to the second pixel group of the display panel in the second field 2SF.

A characteristic information value such as luminance of the data output for each field of FIG. 8A and FIG. 8B may be changed according to an external input data characteristic information value, and in a case of the luminance value, the data value transmitted corresponding to each sub-pixel may be changed from the black luminance to the highest luminance.

According to the data arranging method according to some embodiments, a plurality of first pixels emitting the light in the first field may select the odd-numbered sub-pixels included in each pixel line of the display panel. Also, a plurality of second pixels may select the even-numbered sub-pixels included in each pixel line, that is, the remaining sub-pixels excluding the first pixels.

Also, the first field data Data1-1(B) transmitted to a plurality of first pixels may be arranged for the colors of red (R), blue (B), and green (G) to be alternately displayed according to the pixel column. The second field data Data1-2(B) transmitted to a plurality of second pixels may be arranged for the colors of green (G), red (R), and blue (B) to be alternately displayed according to the pixel column.

Also, the first field data Data1-1(B) and the second field data Data1-2(B) are arranged by using the data corresponding to a plurality of first pixels or a plurality of second pixels and extracted from the input data Data1, and at this time, the black data may be additionally arranged between the pixel column of the corresponding first pixel or the corresponding second pixel. At this time, to insert the black data is a conception including inputting the data value emitting the light with the black luminance, or not driving the sub-pixels corresponding to between the pixel column of the corresponding first pixel or the corresponding second pixel for the non-light emitting.

As described above, the first field data Data1-1(B) and the second field data Data1-2(B) after the black data applied for the sub-pixels positioned between the pixel column of the corresponding first pixel or the corresponding second pixel is inserted may be similar to those shown in FIG. 8A and FIG. 8B.

The first field data Data1-1(B) of FIG. 8A is to map the output data for the portion of pixels corresponding to the first pixel line L1 to the fourth pixel line L4 among the display panel. The output data R11, R21, R31, and R41 transmitted to the first pixels corresponding to the first pixel column are the red data emitting the red light, the output data B11, B21, B31, and B41 transmitted to the first pixels corresponding to the third pixel column are the blue data emitting the blue light, and the output data G12, G22, G32, and G42 transmitted to the first pixels corresponding to the fifth pixel column is the green data emitting the green light. Also, the output data are arranged to be repeatedly changed with the above color sequence every continuous odd-numbered array. Furthermore, the black data as the data transmitted to the pixels (the second pixels) provided between the pixel column may be inserted.

The second field data Data1-2(B) of FIG. 8B mapping the output data for the portion of pixels corresponding to the first pixel line L1 to the fourth pixel line L4 among the display panel is opposite to the data arrangement of FIG. 8A. That is, the output data G11, G21, G31, and G41 transmitted to the second pixels corresponding to the second pixel column are the green data emitting the green light, the output data R12, R22, R32, and R42 transmitted to the second pixels corresponding to the fourth pixel column is the red data emitting the red light, and the output data B12, B22, B32, and B42 transmitted to the second pixels corresponding to the sixth pixel column are the blue data emitting the blue light. Further, the output data is arranged to be repeatedly changed with the above color sequence every continuous-even numbered array. Furthermore, the black data as the data transmitted to the pixels (the first pixels) provided between the pixel columns may be inserted.

Figure 10A:
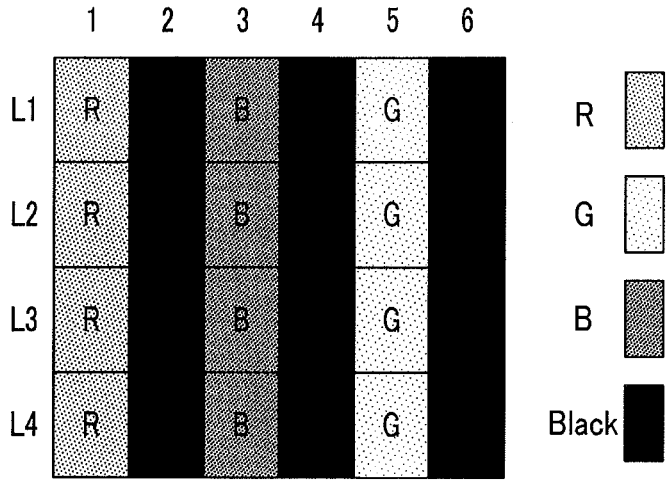
FIG. 10A and FIG. 10B are views showing a shape for each field displayed in a display panel according to each data arrangement of FIG. 8A and FIG. 8B.
Figure 10B:
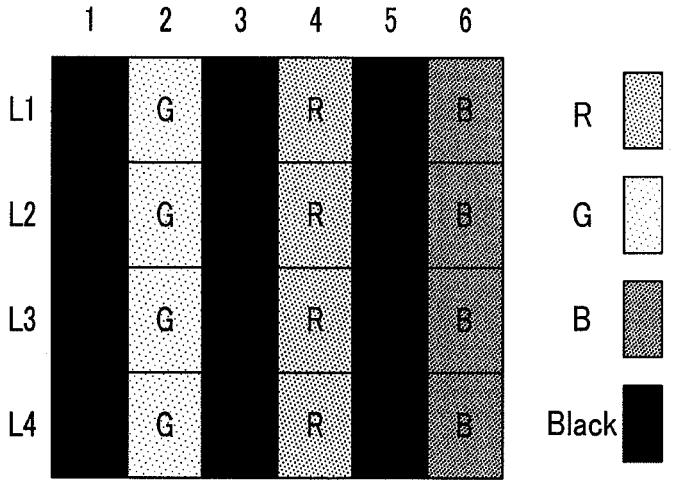

The shape of the display panel emitting the light corresponding to the output data arranged according to the embodiment of FIG. 8A and FIG. 8B is a shape in which the color lines of the red (R), the blue (B), and the green (G) are arranged in a horizontal direction according to the pixel column with the interval of the black line (FIG. 8A), or the color lines of the green (G), the red (R), and the blue (B) are arranged in the horizontal direction with the interval of the black line (FIG. 8B). FIG. 10A and FIG. 10B are the light emitting patterns of the display panel when being driven with the time-division according to each data arrangement of FIG. 8A and FIG. 8B. That is, FIG. 10A is the light emitting pattern of the portion of the display panel in the first field, and FIG. 10B is the light emitting pattern of the portion of the display panel in the second field. This light emitting pattern is not limited such that the arranging sequence of the RGB data displayed by a plurality of pixels included in the pixel column emitting the light may be different.

Figure 9A:
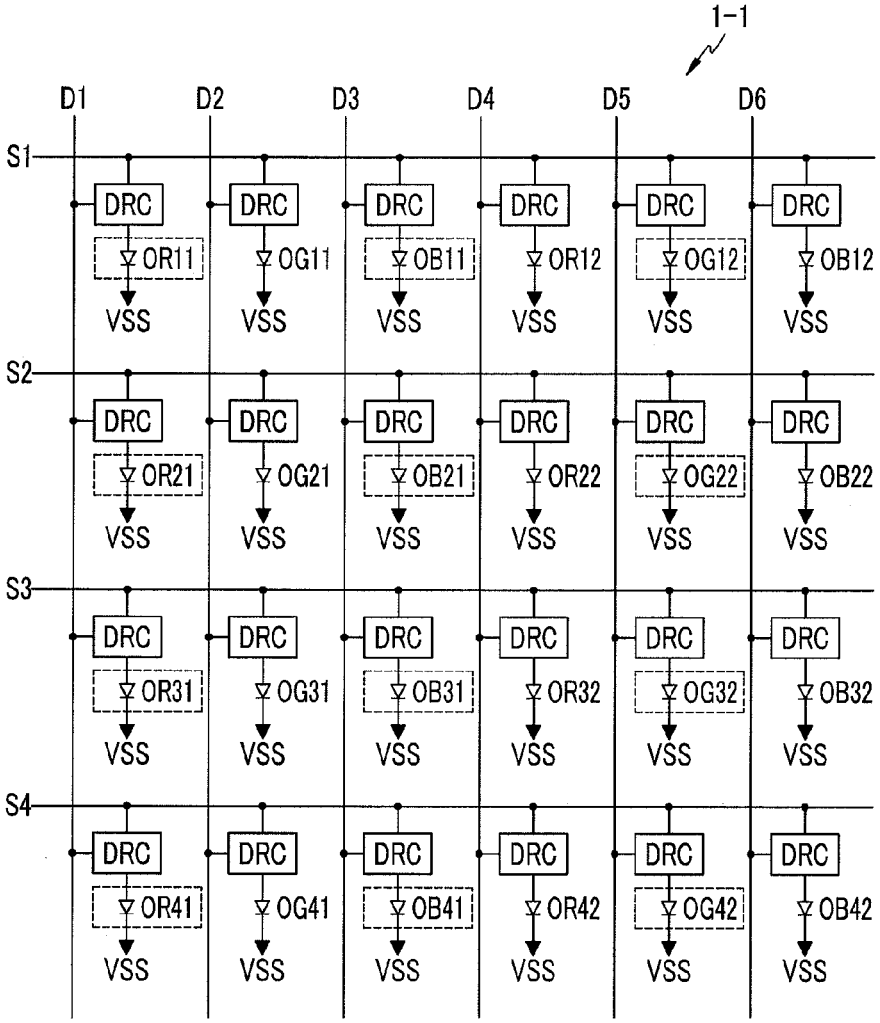
FIG. 9A and FIG. 9B are views to schematically explain pixel driving according to each data arrangement of FIG. 8A and FIG. 8B for each field.
Figure 9B:
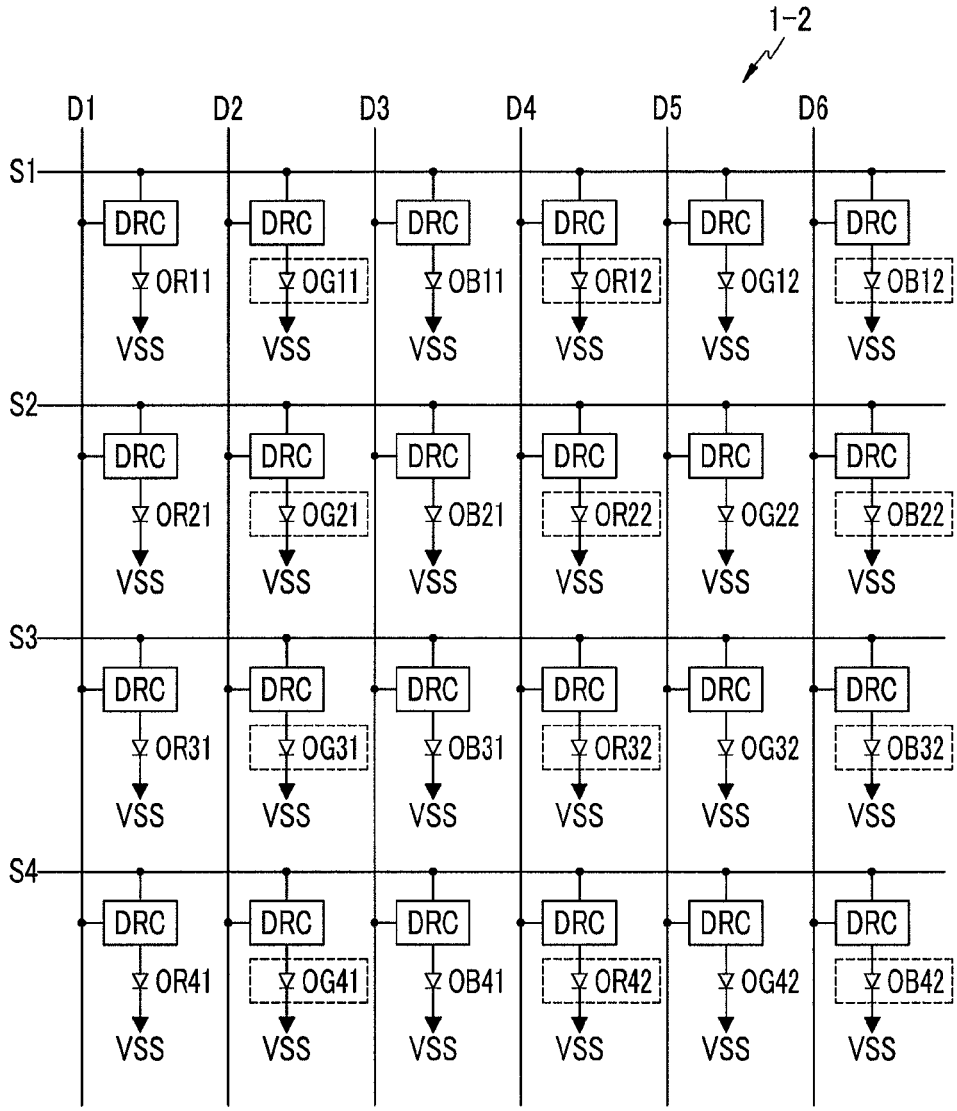

Meanwhile, FIG. 9A and FIG. 9B are views to schematically explain pixel driving according to each data arrangement of FIG. 8A and FIG. 8B for each field. For better understanding and ease of description, the pixels formed in the region including the first to fourth pixel lines and the first to sixth data lines are shown, however the driving of the display panel of the rest of the region is also the same.

FIG. 9A and FIG. 9B represent the circuit structure in the same region of the portion of the display panel such that they are equal to each other. The data signal transmitted through each data line is the data signal corresponding to each field of one frame. That is, the data signal includes the first data signal according to the first output data Data1-1 (B) of FIG. 8A and the second data signal according to the second output data Data1-2(B) of FIG. 8B.

In FIG. 9A and FIG. 9B, the pixel structure between the corresponding scan line and the corresponding data line is the same as that of FIG. 5 such that the description thereof is omitted.

In FIG. 9A and FIG. 9B, the pixels included in the pixel lines L1, L2, L3, and L4 are respectively connected to the first to fourth scan lines S1 to S4, and the pixels included in the first pixel column to the sixth pixel column are respectively connected to the first to sixth data lines D1 to D6.

Among one frame, if the first to fourth scan lines S1 to S4 are sequentially transmitted with the scan signal in the first field, the pixels of the first to fourth pixel lines L1, L2, L3, and L4 connected to the corresponding scan line are sequentially activated. Thus, the first field data Data1-1(B) arranged similar to the embodiment shown in FIG. 8A is applied to the first to sixth data lines D1 to D6, and the corresponding pixel emits the light corresponding to the applied data. For example, the pixel of the first pixel line first column receives the red data R11 such that the organic light emitting diode (OLED) OR11 emits the red light. The second column pixel is input with the black data in the first field data such that the organic light emitting diode (OLED) OG11 does not emit, and the third column pixel receives the blue data B 11 such that the organic light emitting diode (OLED) OB11 emits the blue light. As described above, in the display panel of FIG. 9A, among one frame, the first field data of FIG. 8A is transmitted in the first field such that the organic light emitting diode (OLED) of the corresponding pixel indicated by a dotted line emits the light to display the image.

Meanwhile, in FIG. 9B, the second field data Data1-2(B) arranged according to FIG. 8B is transmitted in the second field among one frame such that the corresponding pixels emit the light.

After driving the display in the first field of a frame according to a driving scheme similar to the driving scheme discussed above with reference to FIG. 9A, the second field is driven. Accordingly, the corresponding scan signal is again sequentially transmitted to the first to fourth scan lines S1 to S4 in the second field. Thus, the pixels of the first to fourth pixel lines L1, L2, L3, and L4 connected to the corresponding scan line are sequentially activated. Also, the first to sixth data lines D1 to D6 are applied with the second field data Data1-2(B) arranged like the embodiment of FIG. 8B, and the corresponding pixel emits the light corresponding to the applied data. For example, the first pixel line first column pixels are applied with the black data in FIG. 8B such that the organic light emitting diode (OLED) OR11 of the pixel does not emit. Also, the second column pixel is applied with the green data G11 in the second field data such that the organic light emitting diode (OLED) OG11 emits the green light. The third column pixel is again transmitted with the black data such that the organic light emitting diode (OLED) OB11 of the pixel does not emit. As described above, in the display panel of FIG. 9B, the second field data of FIG. 8B is transmitted in the second field flowing to the first field among one frame such that the organic light emitting diode (OLED) of the corresponding pixel indicated by the dotted line emits the light thereby displaying the image. The image of the first field displayed through the driving of FIG. 9A and the image of the second field displayed through the driving of FIG. 9B during one frame are displayed with the time interval.

FIG. 10A and FIG. 10B show the pattern of the color emitted by the portion of the corresponding display panel under the time-division driving of FIG. 9A and FIG. 9B. Referring to FIG. 10A and FIG. 10B, the sub-pixels included in each pixel column are transmitted with the color data displaying the same color, and the sub-pixels included in the pixel column emitted via the pixel column that does not emit by the black data are alternately and repeatedly transmitted with the color data such that the light is emitted.

Figure 11A:
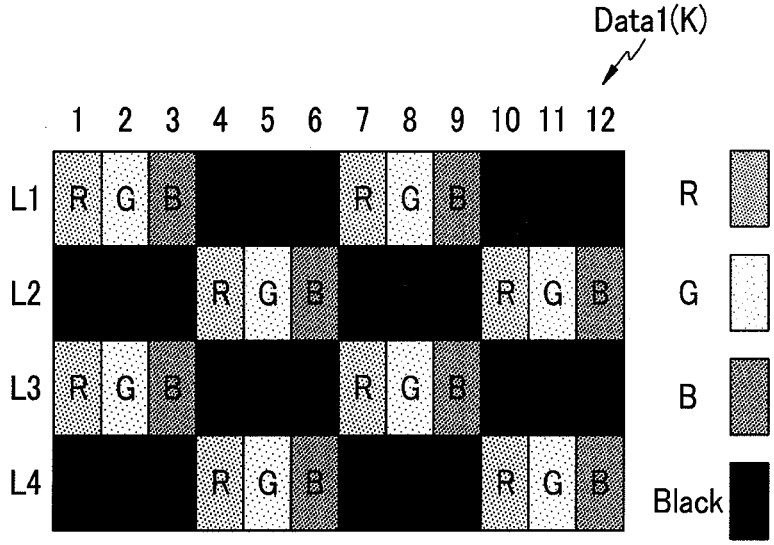
FIG. 11A is a view of a 1 dot pattern as a sub-pixel unit.

FIG. 11A shows display of the 1 dot pattern by the portion of sub-pixels of the display panel according to some embodiments when the input data Data1(K) is transmitted as the 1 dot pattern. That is, the shape displayed corresponding to the input data Data1(K) of the 1 dot pattern is a repeated shape in which one pixel including three RGB sub-pixels emits the light with the highest luminance, and another pixel neighboring the pixel does not emit the light according to the black data of the lowest luminance data with reference to the first pixel line L1. The second pixel line L2 also repeats the shape in which the full white is emitted and the light does not emit as the black as one pixel unit including three RGB sub-pixels, and the shape of a different display image of the pixels of the neighboring first pixel line L1 is repeated. By this method, the input data of the 1 dot pattern is repeated with the shape of FIG. 11A while the full white and the black image are crossed with each other. Also, the shape of which the display panel is displayed for each field corresponding to the input data of the 1 dot pattern is shown in FIG. 11B and FIG. 11C.

For the image display of the first field, the first field data of the shape similar to the embodiment shown in FIG. 8A is divided from the input data Data1(K) according to the 1 dot pattern of FIG. 11A and the black data is inserted between the divided data. Accordingly, the input data according to the 1 dot pattern is extracted as the black data for the green data G12 transmitted to the pixel corresponding to the second column of the first pixel line L1 in FIG. 8A. Likewise, the data G14 is also the black data according to the input data of the 1 dot pattern.

In the second pixel line L2, the data R21 and B21 and the data R23 and B23 are the black data. The color data transmitted to the pixel corresponding to the same pixel column as the first pixel line L1 and the second pixel line L2 is the black data for the third pixel line L3 and the fourth pixel line L4.

Figure 11B:
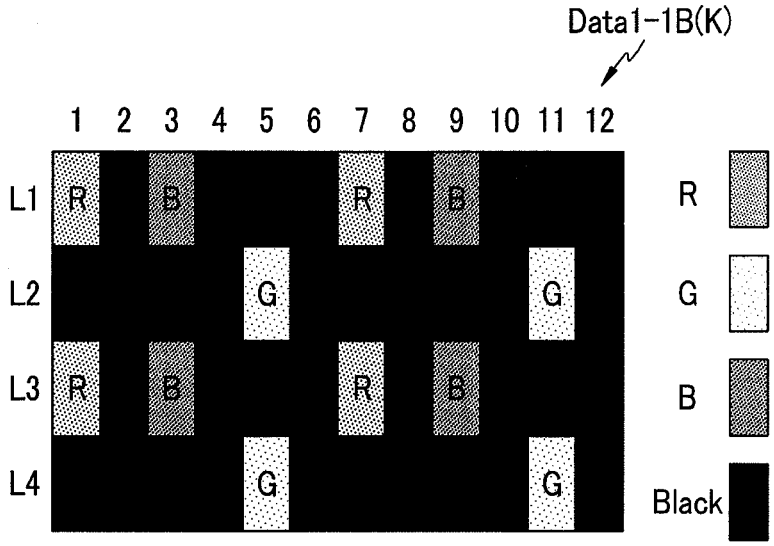
FIG. 11B and FIG. 11C are views showing a shape for each field displayed in a display panel corresponding to input data according to the 1 dot pattern of FIG. 11A.
Figure 11C:
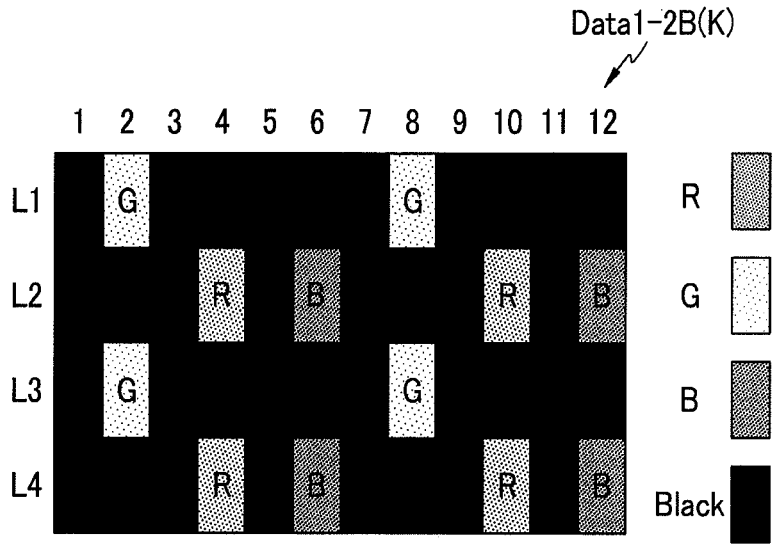

Therefore, the light is emitted similar to the embodiment shown in FIG. 11B. That is, if the input data is transmitted as the 1 dot pattern in the first field, by the data arrangement according to some embodiments, the red and blue light emitting and the green light emitting are alternately executed for the pixel line, and the first field image Data1-1B(K) of the 1 dot pattern is displayed.

Meanwhile, for the image display of the second field, the second field data is divided from the input data Data1(K) according to the 1 dot pattern of FIG. 11A with the shape similar to the embodiment shown in FIG. 8B and the black data is inserted between the divided data. Accordingly, the input data according to the 1 dot pattern is extracted as the black data for the red data R12 and the blue data B12 transmitted to the pixel corresponding to the second column of the first pixel line L1 of FIG. 8B. Likewise, the red data R14 and the blue data B 14 of the same line are extracted as the black data according to the input data of the 1 dot pattern.

In the second pixel line L2, the green data G21 transmitted to the pixel corresponding to the first column and the green data G23 transmitted to the pixel corresponding to the third column are the black data. For the third pixel line L3 and the fourth pixel line L4, the color data transmitted to the pixel corresponding to the same pixel column as the first pixel line L1 and the second pixel line L2 is the black data.

Therefore, the light is emitted similar to the embodiment shown in FIG. 11C. That is, if the input data is transmitted to the 1 dot pattern in the second field, by the data arrangement according to some embodiments, the second field image Data1-2B(K) of the 1 dot pattern is displayed while the green light emitting and the red and blue light emitting are alternately executed for the pixel line.

Although the input data is the 1 dot pattern, the time-division driving according to some embodiments is executed such that the image displayed corresponding to the output data for the first field and the second field is the same as that of FIG. 11A and FIG. 11B. For each field, the display panel uniformly displays the colors of the red, the blue, and the green such that the color division due to the time-division driving is removed.

Figure 12:
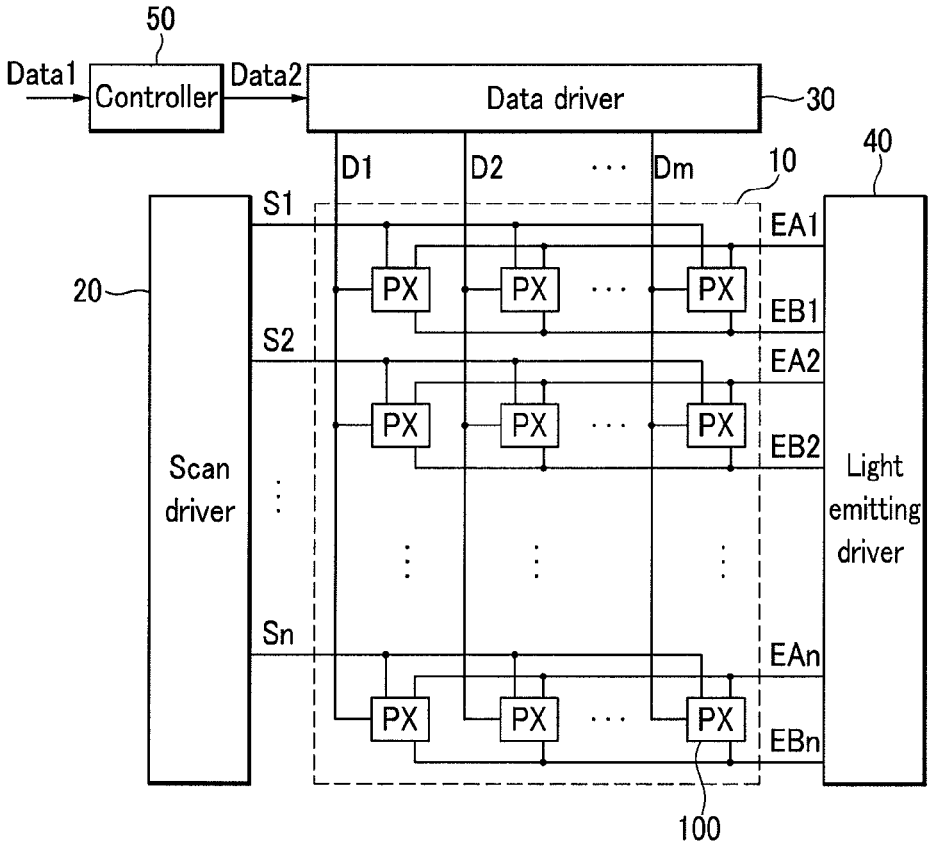
FIG. 12 is a block diagram of a display device according to some embodiments.

FIG. 12 is a block diagram of a display device according to some embodiments.

The display device of FIG. 12 includes a display panel 10 including a plurality of pixels (PX) having a different circuit configuration according to the time-division driving, differently from the general display panel 1 of the display device of FIG. 4.

Also, the display device of FIG. 12 further includes a scan driver 20, a data driver 30, a light emission driver 40, and a controller 50.

Each pixel (PX) of the display panel 10 according to some embodiments includes at least one light emitting element displaying a predetermined R, G, or B color according to the field with the time-division driving during one frame. For example, the continuous pixels in the horizontal direction of the pixel line may respectively include two light emitting elements, and these light emitting elements may sequentially emit the R, G, and B color data.

A plurality of the pixels of the display panel 10 may include two light emitting elements according to some embodiments, and a plurality of light emitting elements may be divided into a light emitting group emitting the light in a predetermined field among one frame. When being divided into two fields for the time-division driving, a plurality of pixels of the display panel 10 may be divided into the first sub-pixel group including a plurality of first light emitting elements emitting the light in the first field and the second sub-pixel group including a plurality of second light emitting elements emitting the light in the second field.

A plurality of pixels are connected to the corresponding scan line of a plurality of scan lines S1-Sn extending in the row direction, the corresponding light emission control line of a plurality of light emission control lines EA1-EAn and EB1-EBn extending in the row direction, and the corresponding data line of a plurality of data lines D 1-Dm extending in the column direction. A plurality of light emission control lines EA1-EAn and EB1-EBn include a plurality of first light emission control lines EA1-EAn and a plurality of second light emission control lines EB1-EBn.

For example, the pixel 100 is formed in the pixel region defined by the last (n-th) scan line Sn of a plurality of scan lines connected to the display panel, the last (n-th) light emission control lines EAn and EBn of a plurality of light emission control lines, and the last (m-th) data line Dm of a plurality of data lines connected to the display panel.

Also, although not shown in FIG. 12, a plurality of pixels included in the display panel are connected to a power wire supplying driving power, and the power wire is connected to a driving power supply unit.

The scan driver 20 sequentially applies the scan signal to a plurality of scan lines S1-Sn for the pixel connected to the corresponding scan line to be input with the data signal. The scan driver 20 sequentially transmits a plurality of scan signals transmitted to all pixels of the display panel 10 for each field according to the time-division driving.

The light emission driver 40 sequentially applies the first light emission control signal to the corresponding first light emission control lines EA1-EAn and the second light emission control signal to the corresponding second light emission control lines EB1-EBn to control the light emitting of the light emitting element included in the pixels (PX). That is, each pixel PX according to some embodiments includes a plurality of light emitting elements displaying the R, G, and B colors, and the first and second light emission control signals supplied in the light emission driver 40 control the light emitting for each field such that the entire display panel 10 has a different color arrangement every field of one frame.

The data driver 30 applies the data signal through the corresponding data line among a plurality of data lines D1-Dm with the pixel activated by the scan signal whenever the scan signal is sequentially applied. The data signal is a data signal according to output data that is arranged and transmitted in the controller 50 for each field. The light emitting element of each pixel emits the light with the driving current according to the applied data signal to display the image.

The controller 5 may arrange the output data Data2 applied from the input data Data1 for each field to realize the image pattern emitting the light every field of one frame in the time-division driving according to some embodiments.

At this time, to display the image emitting the light with a different color arranging pattern according to the control of the first and second light emission control signals supplied in the light emission driver 40 every field of one frame, the controller 50 stores the input data and may extract and arrange the data to be suitable for each field from the stored data. Accordingly, the controller 50 may further include an additional data storing unit storing the input data and the data arranged for each field.

Figure 13:
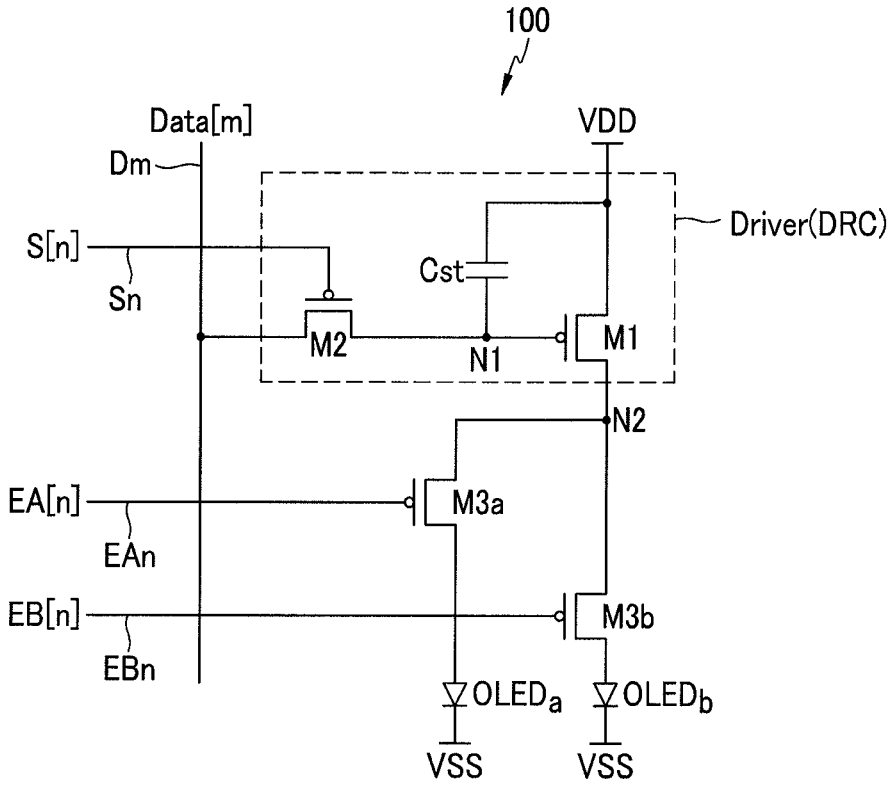
FIG. 13 is a circuit diagram of a pixel structure of the display device of FIG. 12.

FIG. 13 is a circuit diagram of a pixel structure of the display device of FIG. 12.

For example, the pixel 100 of FIG. 13 is the pixel 100 formed in the region defined by the final row and the final column in the matrix structure of the display panel 10 of FIG. 12.

Referring to FIG. 13, the pixel 100 includes one driver DRC and at least two organic light emitting elements OLEDa and OLEDb emitting the light with the driving current according to the corresponding data signal by the activation of the driver. According to the embodiment of FIG. 12, the pixel 100 includes two organic light emitting elements OLEDa and OLEDb respectively emitting the light in each field when one frame has two fields. However, it is not limited to the embodiment of FIG. 13, and each pixel may include a plurality of organic light emitting elements displaying a plurality of colors.

The driver DRC of the pixel 100 includes a driving transistor M1, a switching transistor M2, and a capacitor Cst. Also, the first organic light emitting element OLEDa of two organic light emitting elements OLEDa and OLEDb is connected to a first light emitting transistor M3*a*, and the second organic light emitting element OLEDb is connected to a second light emitting transistor M3*b*.

For example, the driving transistor M1 as a transistor to drive the organic light emitting element includes the source electrode connected to the first power VDD supplying the first power source voltage, the gate electrode connected to a first node N1, and the drain electrode connected to a second node N2. The driving transistor M1 controls the driving current flowing to the organic light emitting elements OLEDa and OLEDb through the first light emitting transistor M3*a* and the second light emitting transistor M3*b* connected to the second node N2 by the voltage difference applied between the gate electrode and the source electrode.

The switching transistor M2 as a transistor selecting the pixel 100 in response to the corresponding scan signal S[n] to activate the driver DRC includes the source electrode connected to the corresponding data line Dm, the gate electrode connected to the corresponding scan line Sn, and the drain electrode connected to the first node N1. If the switching transistor M2 is turned on in response to the scan signal S[n] supplied through the scan line Sn, the corresponding data signal D[m] is transmitted through the data line Dm such that the data voltage according thereto is applied to the first node N1.

The capacitor Cst is connected between the first node N1 and the source electrode of the driving transistor M1, and at this time, the capacitor Cst includes the first electrode connected to the first node N1 and the second electrode connected to the source electrode of the driving transistor M1. The capacitor Cst stores the voltage according to the voltage difference applied to both electrodes, and if the data voltage transmitted through the activation of the driver DRC is applied to the first electrode, the voltage corresponding to the difference along with the first power source voltage applied to the second electrode is stored. The driving current is generated according to the corresponding voltage, and the driving current flows to the organic light emitting element.

Meanwhile, the first light emitting transistor M3*a* as a transistor controlling the light emitting of the first organic light emitting element OLEDa includes the source electrode connected to the second node N2, the gate electrode connected to the corresponding first light emission control line EAn, and the drain electrode connected to the anode of the first organic light emitting element OLEDa.

The second light emitting transistor M3*b* as a transistor controlling the light emitting of the second organic light emitting element OLEDb includes the source electrode connected to the second node N2, the gate electrode connected to the corresponding second light emission control line EBn, and the drain electrode connected to the anode of the second organic light emitting element OLEDb.

When the display device according to some embodiments is time-division driven with two fields during one frame, the pixel 100 of FIG. 13 has two organic light emitting elements emitting the light with the different colors in two fields. For example, the first organic light emitting element OLEDa emits the light according to the driving current in the first field according to the turn-on of the first light emitting transistor M3*a*, and the second organic light emitting element OLEDb emits the light according to the driving current in the second field according to the turn-on of the second light emitting transistor M3*b*. At this time, the first light emitting transistor M3*a* is turned on in response to the first light emission control signal EA[n] applied to the gate electrode, and the second light emitting transistor M3*b* is turned on in response to the second light emission control signal EB[n] applied to the gate electrode.

Two organic light emitting elements OLEDa and OLEDb emit the different colors according to the driving current applied to each anode, thereby respectively emitting the light of red-green, blue-red, and green-blue. As described in FIG. 12, two organic light emitting elements OLEDa and OLEDb included in the pixels neighboring in the horizontal direction may sequentially emit the light with the sequence of the red (R), the green (G), and the blue (B).

Also, according to some embodiments, the cathodes of two organic light emitting elements OLEDa and OLEDb are connected to the second power VSS supplying a second power source voltage that is lower than the first power source voltage. The second power source voltage may be a negative voltage or a ground voltage.

Figure 14:
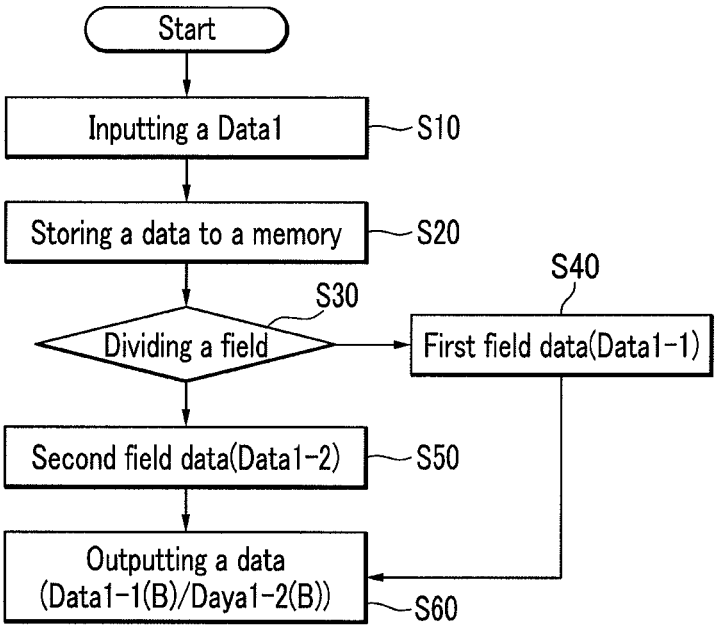
FIG. 14 is a flowchart showing an arranging method of image data in time-division driving of the display device according to some embodiments of FIG. 12 and FIG. 13.

FIG. 14 is a flowchart showing an arranging method of image data in time-division of the display device according to some embodiments of FIG. 12 and FIG. 13.

Firstly, the image data, that is, the input data Data1, is transmitted from the outside of the display device (S10). The display device, according to some embodiments, relates to the data arranging processing and the management thereof to prevent the color division due to the time-division driving method when displaying the image corresponding to the image data input from the outside such that the data signal Data1 input in the step S1 is stored to a data memory according to the characteristic of the time-division driving (S20). For example, when driving one frame at 60 Hz, the input data at 60 Hz can be stored and the data can be output corresponding to a field division number of the frame. According to some embodiments, if one frame is divided into two fields, the output data can be output at 120 Hz two times for each field per frame. In this case, the output data Data2 corresponding to two fields may be arranged.

In the step of S20, the controller outputs the field data corresponding to the divided field per frame from the input data Data1 stored to the data memory, and at this time, whether the corresponding data is included in any field is queried (S30). When being divided into two fields, if the data is included in the first field, the data is output as the first field data Data1-1 in the step S40. Also, if the data is included in the second field, the data is output as the second field data Data1-2 in the step S50.

In the case of the embodiment of FIG. 14, the display panel of the display device is formed to be suitable for the time-division driving such that it is not necessary to insert the black data between the field data similar to the embodiment shown in FIG. 6. Accordingly, the image data Data1-1 and Data1-2 that are arranged for each field in the step S60 are output without the additional input of the black data.

Resultantly, the input data Data1 for one frame is totally transmitted and input, however the output data Data1-1 and Data1-2 for each field respectively applied to a plurality of pixels of the display panel in the controller are output with the arranged state through the process of FIG. 14.

FIG. 15A and FIG. 15B are views of a data map for each field according to a memory arranging method of image data according to some embodiments.

The data map for each field according to the embodiment of FIG. 15A and FIG. 15B is extracted from the input data Data1 map of FIG. 7, similar to the embodiments shown in FIG. 8A and FIG. 8B. However, the data value indicated in FIG. 15A and FIG. 15B is a data value of which one organic light emitting element of two organic light emitting elements included in one pixel emits the light such that the conception of the R sub-pixel, the G sub-pixel, and the B sub-pixel described in FIG. 7 can be respectively substituted with the conception of the organic light emitting element emitting the light of the RGB color.

For example, "R23" in FIG. 7 is the red signal data transmitted to the organic light emitting element emitting the red light and included in the fourth pixel of the second pixel line L2. This is the reason that the data map shown in FIG. 7 may be substituted with the mapping with the organic light emitting element representing the color, and two organic light emitting elements are included in one pixel.

The output data for each field rearranged through the process of FIG. 14 according to the time-division driving, according to some embodiments, from the input data Data1 arranged similar to the embodiment shown in FIG. 7 and including the image information is shown in FIG. 15A and FIG. 15B.

That is, FIG. 15A is the first field data Data1-1 map transmitted to the first light emitting elements (the organic light emitting element) corresponding to the first sub-pixel group of the display panel in the first field 1SF, and FIG. 15B is the second field data Data1-2 map transmitted to the second light emitting elements (the organic light emitting element) corresponding to the second sub-pixel group of the display panel in the second field 2SF.

The characteristic information value such as the luminance of the data output for each field of FIG. 15A and FIG. 15B is changed according to the external input data characteristic information value, and in the case of the luminance value, the data value transmitted corresponding to each light emitting element is changed from the black luminance to the highest luminance.

According to some embodiments, a plurality of first light emitting elements emitting the light in the first field may be the first-first organic light emitting elements among two organic light emitting elements included in a plurality of pixels included in each pixel line of the display panel. Also, a plurality of second light emitting elements may be the second-second organic light emitting elements of two organic light emitting elements included in a plurality of pixels included in each pixel line of the display panel.

Also, the first field data Data1-1 transmitted to a plurality of first light emitting elements may be arranged for the colors of red (R), blue (B), and green (G) to be alternately displayed according to the sub-pixel column. The second field data Data1-2 transmitted to a plurality of second light emitting elements may be arranged for the colors of green (G), red (R), and blue (B) to be alternately displayed according to the sub-pixel column.

Further, the first field data Data1-1 and the second field data Data1-2 are arranged by extracting the data transmitted corresponding to a plurality of first light emitting elements or a plurality of second light emitting elements from the input data Data1, and at this time, the pixel structure including two organic light emitting elements according to some embodiments is suitable for the time-division driving such that it is not necessary to additionally input the black data.

That is, only the data corresponding to the light emitting element for the light emitting in each field is extracted and arranged from the input data.

As described above, the first field data Data1-1 and the second field data Data1-2 applied for the corresponding first light emitting element or the corresponding second light emitting element are equal to FIG. 15A and FIG. 15B.

The first field data Data1-1 of FIG. 15A is to map the output data for the portion of sub-pixels corresponding to the first pixel line L1 to the fourth pixel line L4 of the display panel. The output data R11, R21, R31, and R41 transmitted to the first light emitting elements corresponding to the first sub-pixel column is the red data emitting the red light, the output data B11, B21, B31, and B41 transmitted to the first light emitting elements corresponding to the second sub-pixel column is the blue data emitting the blue light, and the output data G12, G22, G32, and G42 transmitted to the first light emitting elements corresponding to the third sub-pixel column is the green data emitting the green light. Also, the output data is arranged to be repeatedly changed with the above color sequence every odd-numbered sub-pixel column.

The second field data Data1-2 of FIG. 15B is to map the output data for the portion of sub-pixels corresponding to the first pixel line L1 to the fourth pixel line L4 among the display panel, and is opposite to the data arrangement of FIG. 15A. That is, the output data G11, G21, G31, and G41 transmitted to the second light emitting elements corresponding to the first sub-pixel column is the green data emitting the green light, the output data R12, R22, R32, and R42 transmitted to the second light emitting elements corresponding to the second sub-pixel column is the red data emitting the red light, and the output data B12, B22, B32, and B42 transmitted to the second light emitting elements corresponding to the third sub-pixel column is the blue data emitting the blue light. Also, the output data is arranged to be repeatedly changed with the above color sequence every even-numbered sub-pixel column.

The shape of the display panel emitting the light corresponding to the output data arranged according to the embodiment of FIG. 15A and FIG. 15B is a shape in which the color lines of the red (R), the blue (B), and the green (G) are arranged in the horizontal direction according to the sub-pixel column with the intervals (FIG. 15A), or the color lines of the green (G), the red (R), and the blue (B) are arranged in the horizontal direction with the intervals (FIG. 15B). The intervals on screen of the display panel are shown as black line. When the light emitting elements (the first light emitting elements) emit the light in the predetermined field (the first field), the light emitting elements (the second light emitting elements) emitting the light in the other field (the second field) does not emit the light such that the interval of the black line is generated in each field shape of the display panel. The shape of each field of the display panel is not different from FIG. 10A and FIG. 10B.

Figure 16A:
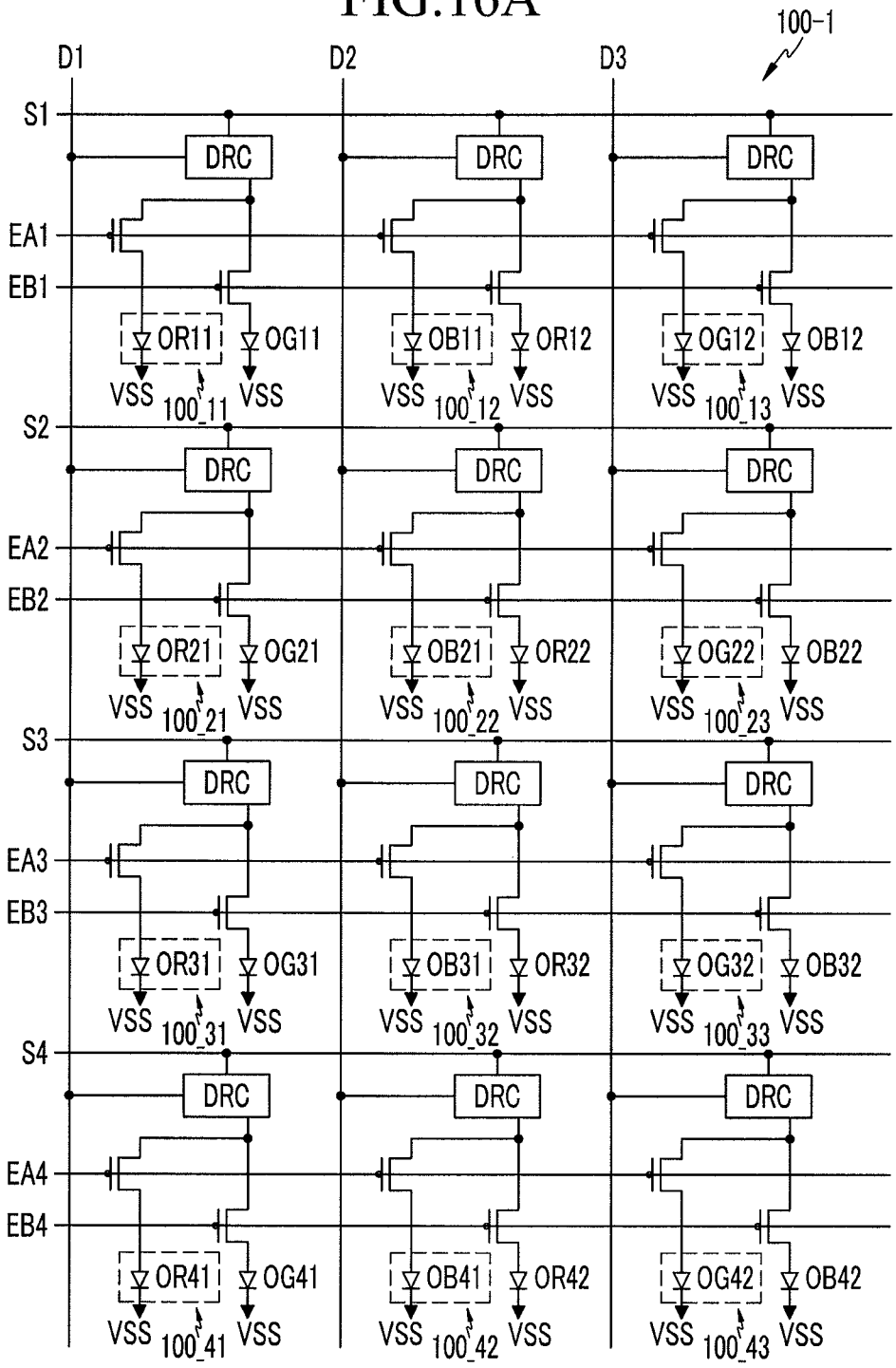
FIG. 16A and FIG. 16B are views to schematically explain pixel driving according to each data arrangement of FIG. 15A and FIG. 15B for each field.
Figure 16B:
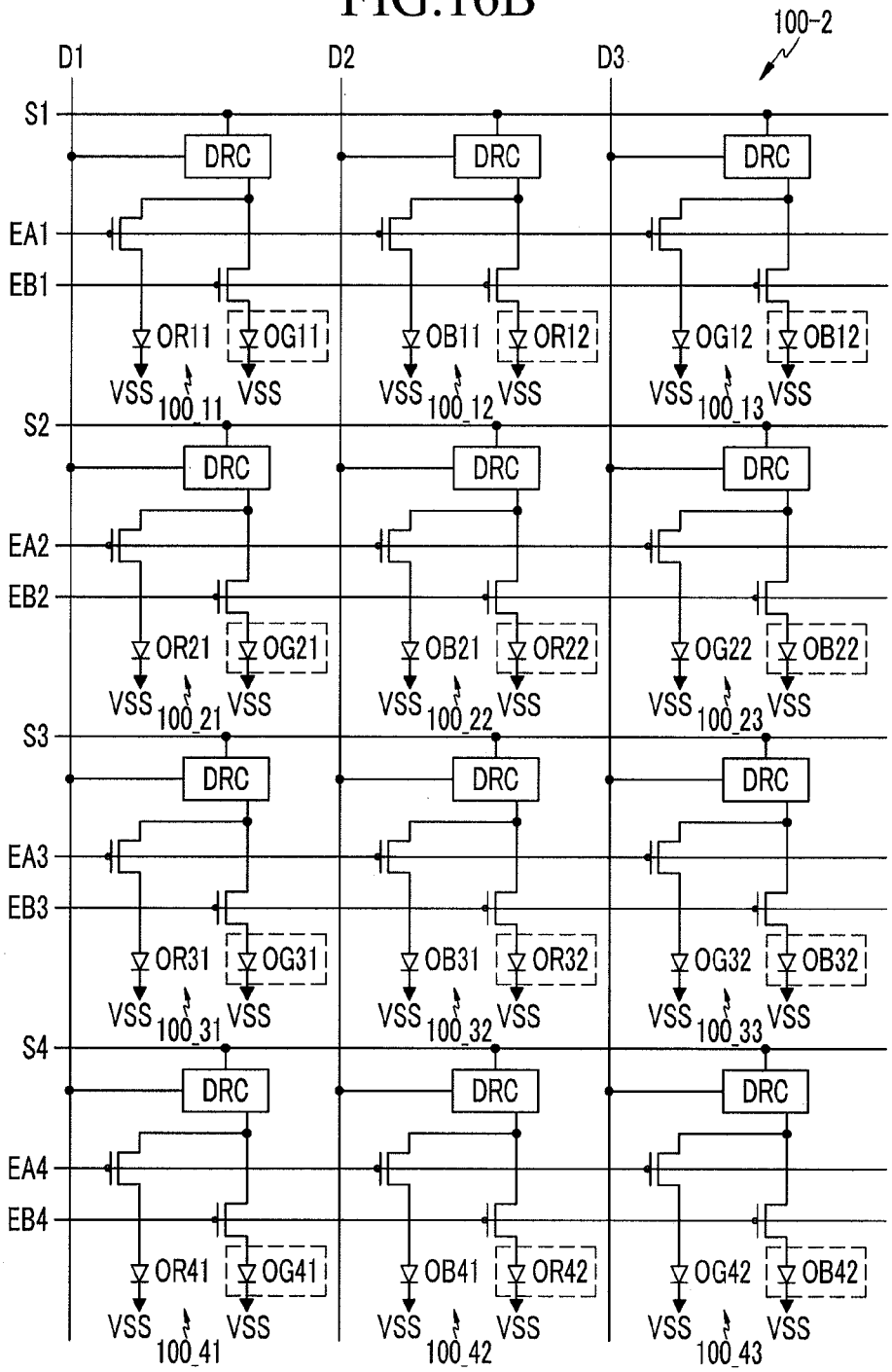

FIG. 16A and FIG. 16B are views to schematically explain pixel driving according to each data arrangement of FIG. 15A and FIG. 15B for each field. Better understanding and ease of description, the pixels formed in the region formed by the first to fourth pixel lines and the first to third data lines are shown, however the driving of the display panel of the rest of the region is also the same.

The circuit structures in the same region of the portion of the display panel of FIG. 16A and FIG. 16B are the same. Also, the data signal transmitted through each data line includes the first data signal according to a plurality of first field data transmitted to a plurality of first light emitting elements emitting the light in the first field of one frame, and the second data signal according to a plurality of second field data transmitted to a plurality of second light emitting element emitting the light in the second field of one frame.

There is a difference that the data is divided into the first field data of FIG. 16A and the second field data of FIG. 16B to be transmitted. Also, one of two organic light emitting elements included in one pixel functions as the first light emitting element emitting the light in the first field for the first field driving of FIG. 16A, and the other functions as the second light emitting element emitting the light in the second field for the second field driving of FIG. 16B.

For example, FIG. 16A is a circuit diagram to explain the pixel driving corresponding to the repetition pattern unit 100-1 in the first field of FIG. 15A. Also, FIG. 16B is the circuit diagram to explain the pixel driving corresponding to the repetition pattern unit 100-2 in the second field of FIG. 15B.

The pixel circuit structures included in the repetition pattern units of FIG. 16A and FIG. 16B are the same, however the organic light emitting elements emitting the light in the corresponding field are different. Accordingly, for better understanding and ease of description, FIG. 16A will be described.

Referring to FIG. 16A and FIG. 16B, when focusing on the repetition pattern unit, the arrangement structure of each pixel included in the display panel according to some embodiments is the same as the circuit diagram of FIG. 13. Accordingly, the driver DRC of the pixel that is activated by the input of the corresponding scan signal is the same as that of FIG. 13.

In FIG. 16A and FIG. 16B, the repetition pattern unit means a color pattern of the region corresponding to the first pixel to the third pixel included in the first pixel line L1 to the fourth pixel line L4.

For example, the first pixel line L1 includes the first pixel (100_11), the second pixel (100_12), and the third pixel (100_13), the second pixel line L2 includes the first pixel (100_21), the second pixel (100_22), and the third pixel (100_23), the third pixel line L3 includes the first pixel (100_31), the second pixel (100_32), and the third pixel (100_33), and the fourth pixel line L4 includes the first pixel (100_41), the second pixel (100_42), and the third pixel (100_43).

These pixels include two organic light emitting elements, and in the description, they are indicated by the first light emitting element and the second light emitting element. Also, the first light emitting element and the second light emitting element may be defined as a sub-pixel conception included in one pixel.

The first light emitting element and the second light emitting element of the first to third pixels of each pixel line L1, L2, L3, and L4 corresponding to the same sub-pixel column are organic light emitting elements emitting light of the same color, and are repeated and disposed with the RGB sequence in the horizontal direction (the line direction) as shown in FIG. 16A.

That is, for example, referring to the line direction of the organic light emitting element of the pixels of the first pixel line L1, the first pixel (100_11) includes the red organic light emitting element OR11 as the first light emitting element and the green organic light emitting element OG11 as the second light emitting element, the second pixel (100_12) includes the blue organic light emitting element OB11 as the first light emitting element and the red organic light emitting element OR12 as the second light emitting element, and the third pixel (100_13) includes the green organic light emitting element OG12 as the first light emitting element and the blue organic light emitting element OB12 as the second light emitting element. Each pixel of the second pixel line L2 to the fourth pixel line L4 in the repetition pattern unit includes the organic light emitting elements arranged the same as the chromophore pattern of the organic light emitting elements included in the first pixel line L1.

Also, the anode of two organic light emitting elements included in one pixel in the repetition pattern unit of FIG. 16A and FIG. 16B is connected to the light emitting transistor controlling the light emitting driving of the element by controlling the flowing of the driving current as described in FIG. 13. The switching of the light emitting transistor is controlled by receiving the light emission control signal from the light emission control line connected to the gate electrode thereof.

To drive each sub-pixels of the display panel corresponding to the image data arranged according to some embodiments, the arrangement of the light emission control line is provided.

In the repetition pattern unit of FIG. 16A and FIG. 16B, the scan line connected to the driver DRC and two light emission control lines are separately connected for each line. That is, the first light emission control line transmitting the first light emission control signal to control the light emitting in the first field and the second light emission control line transmitting the second light emission control signal to control the light emitting in the second field are connected for each pixel line L1, L2, L3, and L4.

Two light emission control lines connected to one pixel line are connected to the gate electrode of the light emitting transistor respectively controlling the driving of the organic light emitting elements, and the connection sequence of two light emission control lines is the same for each line in the repetition pattern unit.

That is, the first light emission control line EA of two light emission control lines connected to one pixel line is connected to the first light emission control transistor of the corresponding pixel such that the first light emitting element connected to the first light emission control transistor emits the light in the first field.

Likewise, the second light emission control line EB of two light emission control lines connected to one pixel line is connected to the second light emission control transistor of the corresponding pixel such that the first light emitting element connected to the second light emission control transistor emits the light in the second field.

For example, the R, B, and G organic light emitting elements (the first light emitting elements) for the first to third pixels 100_11 to 100_13 of the first pixel line L1 emit the light like the dotted line in response to the first light emission control signal applied to the first-first light emission control line EA 1 in the first field of FIG. 16A. In contrast, the G, R, and B organic light emitting elements (the second light emitting elements) for the first to third pixels 100_11 to 100_13 of the first pixel line L1 emit the light like the dotted line in response to the second light emission control signal applied to the first-second light emission control line EB1 in the second field of FIG. 16B.

The other pixel lines of the rest of the repetition pattern unit are equally driven.

According to some embodiments, the light emitting is executed according to two light emission control signals of each field after the field data that is differently arranged in each field forming one frame. The light emitting pattern of the display panel repeats the repetition pattern unit of each field such that the first field and the second field continuously display the image during one frame, however each field is sequentially progressed to the final line in the line direction and the column direction. In general, the frame may be output 60 times per second.

Figure 17:
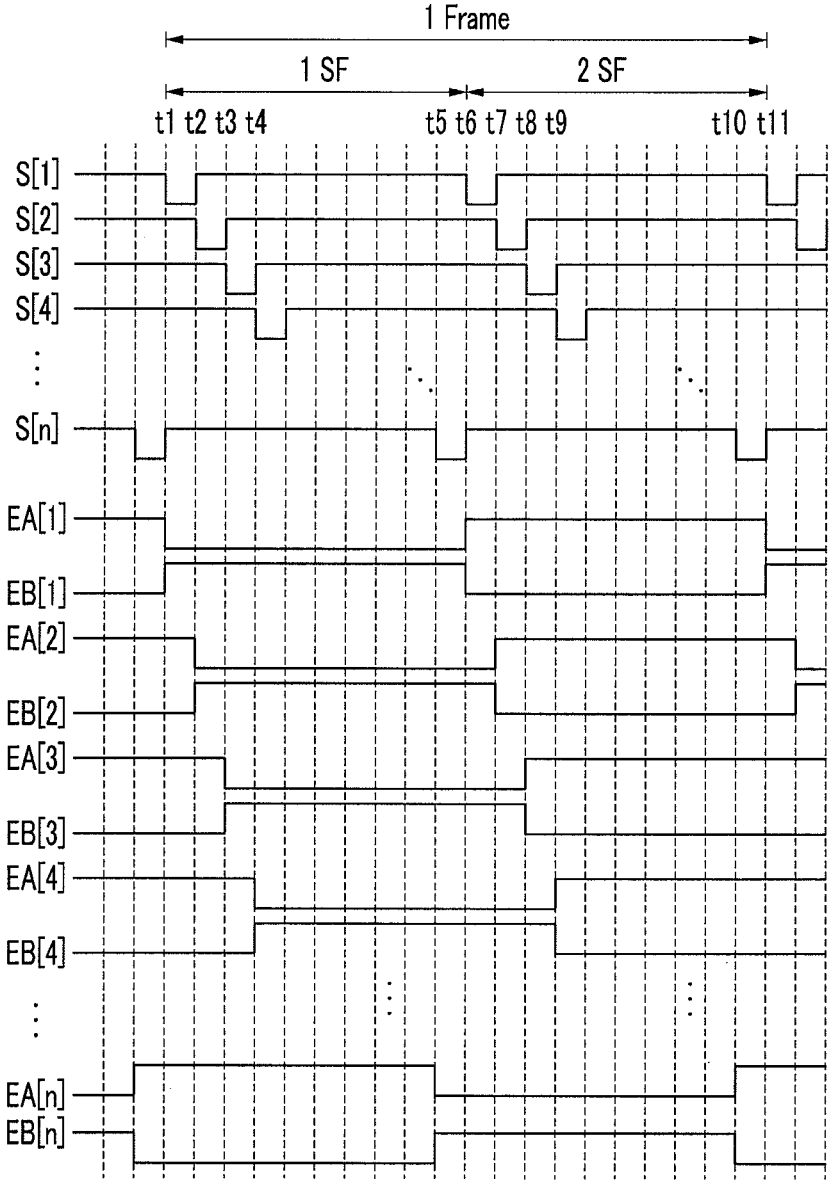
FIG. 17 is a timing diagram to explain light emitting driving of a pixel according to FIG. 16A and FIG. 16B.

FIG. 17 is a timing diagram to explain light emitting driving of a pixel according to FIG. 16A and FIG. 16B.

Referring to the circuit structure corresponding to the repetition pattern unit of the display panel according to some embodiments shown in FIG. 16A and FIG. 16B, the driving process of the light emission control will be described.

The display device according to some embodiments is divided into two fields 1SF and 2SF to be driven during one frame (1 Frame). Another frame following the one frame is distinguished by a vertical synchronization signal Vsync applied to the display device. In FIG. 17, one frame is started by the vertical synchronization signal Vsync applied directly after the time t1 and the time t11.

The light emitting is continuous in two fields during one frame to realize the image of one frame of the entire display panel such that a plurality of scan signals transmitted to the display panel are transmitted as an on-level voltage of the transistor with the interval of ½ a frame period. According to some embodiments, the pixels include the PMOS transistor as shown in FIG. 13 such that the on level voltage of the signals of FIG. 17 is the low level voltage.

Also, a plurality of first and second light emission control signals transmitted to the first and second light emitting transistors controlling the light emitting of two organic light emitting elements of each pixel are transmitted with a different phase per interval of ½ a frame period. Also, the first light emission control signals EA[1]-EA[n] light-emitting the organic light emitting elements (the first light emitting elements) of the first field and the second light emission control signals EB[1]-EB[n] light-emitting the organic light emitting elements (the second light emitting elements) of the second field have a reserve voltage level to each other in each field.

For example, referring to FIG. 17, in each field 1SF and 2SF, a plurality of scan lines connected to each pixel line are sequentially applied with a plurality of scan signals. That is, the first scan line to the last scan line are sequentially applied with the first scan signal S[1] to the last scan signal S[n] as the low level voltage at the times t1, t2, t3, t4, . . . , t5 of the first field 1SF. Thus, the drivers DRCs of the pixels included in each pixel line are sequentially activated. Likewise, the first scan line to the last scan line are sequentially applied with the first scan signal S[1] to the last scan signal S[n] as the low level voltage at the times t6, t7, t8, t9, . . . , t10 of the second field 2SF after the first field 1SF is finished. Thus, the drivers DRCs of the pixels included in each pixel line are sequentially activated.

The data voltage according to the data arranged for each field is applied from the data line corresponding to each pixel through the application of a plurality of scan signals such that the driving current flows to the organic light emitting element of each pixel. Among two organic light emitting elements included in each pixel, the first light emitting element of the first organic light emitting element emits the light in the first field, and the second light emitting element of the second organic light emitting element emits the light in the second field.

As described above, the selective light emitting driving of the organic light emitting element for each field is controlled by the first light emission control signal and the second light emission control signal.

For example, if the first scan line is applied with the first scan signal S[1] of the low level at the time t1, the first field data Data1-1 corresponding to the first field is applied from the data lines D1 to D3 corresponding to the pixels included in the first pixel line. The data voltage according to the data is stored to the capacitor of each pixel. Also, in synchronization with the application of the low level of the first scan signal S[1], the first light emission control signal EA[1] is converted into the low level voltage and is applied to the first-first light emission control line, and the second light emission control signal EB[1] is converted into the high level voltage of the opposite phase and is applied to the first-second light emission control line. FIG. 16A shows the pixel corresponding to the repetition pattern unit of the first field, the first light emission control signal EA[1] is connected to the gate electrode of the first light emitting transistor connected to the first light emitting element of the pixels (100_11 to 100_13) of the first pixel line. The second light emission control signal EB[1] is connected to the gate electrode of the second light emitting transistor connected to the second light emitting element of the pixels (100_11 to 100_13) of the first pixel line. Accordingly, in response to the first light emission control signal (EA[1]) applied as the low level voltage, the first light emitting transistor is turned on such that the driving current corresponding to the first field data voltage is transmitted to the first light emitting element through the first light emitting transistor for the light emitting. The light is emitted with the RBG color sequence in the row direction of the first pixel line.

At this time, the second light emitting transistor connected to the second light emitting element of each pixel of the first pixel lines is turned off by the second light emission control signal EB[1] applied as the high level voltage, and thereby the second light emitting element is not light-emitted.

Meanwhile, the first scan line is again applied with the first scan signal S[1] as the low level in the second field at the time t6, and the voltage phase of the first light emission control signal (EA[1]) and the second light emission control signal (EB[1]) transmitted to the first-first and the first-second light emission control lines is exchanged according to the synchronization thereof. Accordingly, as shown in FIG. 16B showing the pixel corresponding to the repetition pattern unit of the second field, the second light emitting transistor connected to the second light emitting element of each pixel of the first pixel lines is turned on by the second light emission control signal (EB[1]) that is converted into the low level voltage and transmitted in the second field. Accordingly, the driving current corresponding to the second field data voltage applied by the first scan signal S[1] transmitted at the time t6 is transmitted to the second light emitting element of each pixel of the first pixel line, thereby realizing the light emitting. The light is emitted with the GRB color sequence in the row direction of the first pixel line.

At this time, the first light emitting transistor connected to the first light emitting element of each pixel of the first pixel line is turned off by the first light emission control signal (EA[1]) that is converted into the high level voltage and is applied, and thereby the first light emitting element is not light-emitted.

Next, for the remaining pixel lines, in synchronization with the scan signal sequentially applied to according to each pixel line, the first and second light emission control signals are sequentially applied as the low level voltage and the high level voltage in the first field 1SF, and the first and second light emission control signals are converted into the high level voltage and the low level voltage and are sequentially applied in the second field 2SF. Thus, the dotted line portion of FIG. 16A emits the light in the first field 1SF and the dotted line portion of FIG. 16B emits the light in the second field 2SF.

FIG. 18A and FIG. 18B are views showing an image data map for each field extracted from input data according to a 1 dot pattern by a memory arranging method of image data according to some embodiments.

That is, FIG. 18A and FIG. 18B are views mapping the first field data and the second field data output for each field through the process of FIG. 14 from the input data of the 1 dot pattern when transmitting as the 1 dot pattern in which the full white image and the black image are alternately display as the pixel unit including three sub-pixels while the input data Data1 is arranged similar to the embodiment shown in FIG. 7. The shape of the portion of the sub-pixel of the display panel emitting the light according to the input data of the 1 dot pattern is to the same as FIG. 11A. In FIG. 11A, the 1 dot region as one pixel is shown as the region including three sub-pixels, however in some embodiments, one pixel including two sub-pixels (two light emitting elements) is defined such that the 1 dot region of FIG. 11A may be considered as the region corresponding to three light emitting elements.

Accordingly, the output data of FIG. 18A and FIG. 18B are arranged with the method of the field data map as shown in FIG. 15A and FIG. 15B, and are extracted from the input data of the 1 dot pattern such that the data transmitted to the light emitting element corresponding to the dot region where the black image is displayed becomes the black data.

For example, for the image display of the first field, the first field data is divided with the shape similar to the embodiment shown in FIG. 18A from the input data Data1(K) according to the 1 dot pattern of FIG. 11A.

At this time, in the 1 dot pattern of FIG. 11A, the second dot region of the first pixel line L1 displays the black image such that the green data G12 transmitted to the first light emitting element corresponding to the second dot region is the black data.

Likewise, the fourth dot region of the first pixel line L1 displays the black image such that the green data G14 transmitted to the first light emitting element corresponding to the fourth dot region is the black data.

Also, the first dot region and the third dot region display the black image in the second pixel line L2 such that the R21 and B21 data and the R23 and B23 data transmitted to the first light emitting elements corresponding thereto are the black data. For the third pixel line L3 and the fourth pixel line L4, the color data transmitted to the first light emitting element corresponding to the same dot region as the first pixel line L1 and the second pixel line L2 is the black data.

Figure 19A:
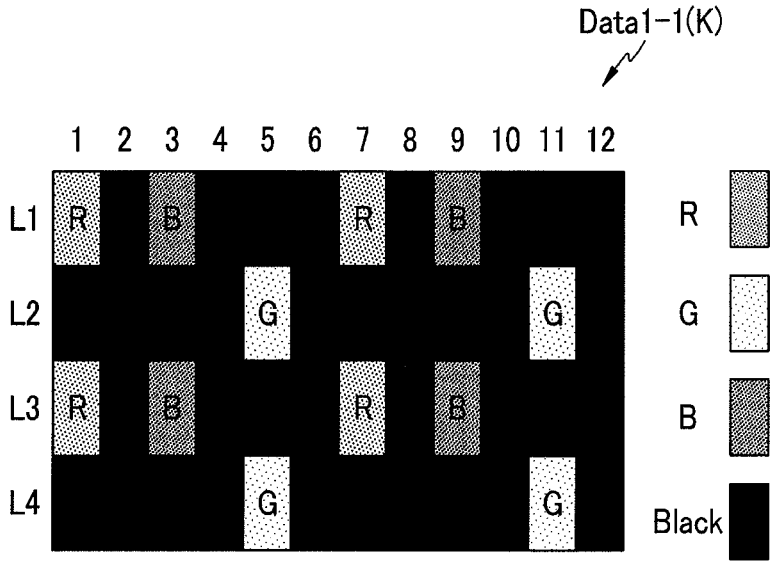
FIG. 19A and FIG. 19B are views showing a shape for each field displayed in a display panel corresponding to input data according to a 1 dot pattern.

Thus, the light is emitted similar to the embodiment shown in FIG. 19A. That is, if the input data is transmitted to the 1 dot pattern in the first field, the red and blue light emitting and the green light emitting alternate for each pixel line by the data arrangement according to some embodiments, and thereby the first field image Data1-1(K) of the 1 dot pattern is displayed.

Meanwhile, to display the image of the second field image, the second field data is different with the shape similar to the embodiment shown in FIG. 18B from the input data Data1(K) according to the 1 dot pattern of FIG. 11A.

At this time, the second dot region of the first pixel line L1 displays the black image in the 1 dot pattern of FIG. 11A such that the red data R12 and the blue data B12 transmitted to the second light emitting element corresponding to the second dot region are the black data.

Likewise, the fourth dot region of the first pixel line L1 displays the black image such that the red data R14 and the blue data B14 transmitted to the second light emitting element corresponding to the fourth dot region are the black data.

Also, the first dot region and the third dot region display the black image in the second pixel line L2 such that the data G21 and the data G23 transmitted to the second light emitting elements is the black data. The color data transmitted to the second light emitting element corresponding to the same dot region as the first pixel line L1 and the second pixel line L2 is the black data for the third pixel line L3 and the fourth pixel line L4.

Figure 19B:
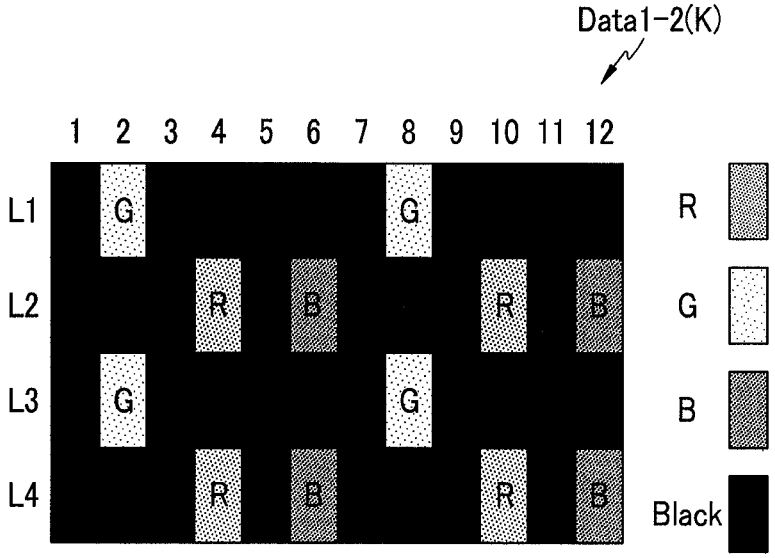

Accordingly, light is emitted as shown in FIG. 19B. That is, if the input data is transmitted as the 1 dot pattern in the second field, the green light emitting and the red and blue light emitting are alternated for each pixel line by the data arrangement according to some embodiments, and thereby the second field image Data1-2(K) of the 1 dot pattern is displayed.

According to some embodiments, a display device is disclosed which is configured to classify the image data into a type that is suitable for the light emitting driving method, effectively manage the memory, and reduce and remove the color division phenomenon when generating the disruptive pattern to realize good image quality with high efficiency.

The technical objects to be achieved are not limited to the above-mentioned objects, and other technical objects that have not been mentioned above will become evident from the following description.

A display device according to some embodiments includes: a display panel including a plurality of first pixels emitting light in a first field and a plurality of second pixels emitting light emitting in a second field, a controller extracting a plurality of first field data transmitted to a plurality of first pixels in the first field and a plurality of second field data transmitted to a plurality of second pixels in the second field from input data, dividing a plurality of first field data as a line unit, inserting black data between two neighboring first field data among a plurality of first field data of one line unit to generate first output data, dividing a plurality of second field data as a line unit, and inserting the black data between two neighboring second field data among a plurality of second field data of one line unit, and a data driver transmitting a first data signal according to the first output data to the display panel in the first field and transmitting a second data signal according to the second output data to the display panel in the second field.

A display device according to some embodiments includes: a display panel including a plurality of pixels including a first light emitting element emitting light in a first field and a second light emitting element emitting light in a second field, a controller extracting a plurality of first field data transmitted to a plurality of first light emitting elements in the first field and a plurality of second field data transmitted to a plurality of second light emitting elements in a second field from input data, and a data driver transmitting the first data signal according to a plurality of first field data to the display panel in the first field and transmitting the second data signal according to a plurality of second field data to the display panel in the second field.

The first field data is respectively transmitted to the first light emitting elements included in three pixels continuous in one direction such that at least three color data emitting the light of the different colors are repeatedly arranged, and the second field data is respectively transmitted to the second light emitting elements included in three pixels continuous in one direction such that at least three color data emitting the light of the different colors are repeatedly arranged.

When the input data has 1×1 dot pattern information such that a white image and a black image are crossed and displayed in a first direction and a second direction perpendicular to each other, a distribution ratio between the colors in the image displayed by the first output data and the distribution ratio between the colors in the image displayed by the second output data are equal to each other.

Predetermined color distribution ratios of the images displayed by the first output data and the second output data may be equal to each other. Accordingly, the color division by the imbalance of the distribution ratio of the color data of the high luminance such as the green data may be prevented.

A method of arranging image data of a display device in which one frame is driven in a first field and a second field, and generating output data transmitted to the display panel from the input data in the first field and the second field, thereby displaying an image for each field, is provided.

The method includes: storing input data to a data memory, dividing a plurality of first field data transmitted to a plurality of first elements emitting light in the first field and a plurality of second field data transmitted to a plurality of second elements emitting light in the second field from the stored input data, and generating a plurality of first field data and a plurality of second field data as first output data and second output data, transmitting the first data signal according to a plurality of first output data to a plurality of first elements in the first field, and transmitting a second data signal according to a plurality of second output data to a plurality of second elements in the second field.

The method may further include dividing the plurality of first field data as a line unit, inserting black data between two neighboring first field data among a plurality of first field data of one line unit, dividing the plurality of second field data as a line unit, and inserting black data between two neighboring second field data among a plurality of second field data of one line unit, after dividing a plurality of first field data and a plurality of second field data.

According to some embodiments, the image data stored to the memory of the display device is arranged with a shape that is suitable for the light emitting driving method, and the memory arranging method of the image data preventing the disruptive pattern in the image display according to the image data may be provided.

When the disruptive pattern according to the image pattern is generated in the time-division driving method of the display device is generated, a display device solving the screen failure phenomenon such as false contour and color division and realizing an image of high quality may be provided.

While some embodiments of the present invention have been particularly shown and described with reference to the accompanying drawings, the specific terms used herein are used for the purpose of describing the invention and are not intended to define the meanings thereof or be limiting of the scope of the invention set forth in the claims. Therefore, various modifications and equivalent embodiments of the present invention are possible. Further, a person of ordinary skill in the art can omit part of the constituent elements described in the specification without a reduction in performance or can add constituent elements for improved performance. In addition, a person of ordinary skill in the art can change the devices and methods described based on the process conditions or equipment. Hence, the range of the present invention is to be determined by the claims and equivalents.

What is claimed is:

1. A display device comprising:

a display panel including a plurality of first pixels emitting light in a first field and a plurality of second pixels emitting light emitting in a second field;

a controller configured to:

extract a plurality of first field data to be transmitted to the plurality of first pixels in the first field and a plurality of second field data to be transmitted to the plurality of second pixels in the second field from input data;

divide the plurality of first field data into a plurality of line units;

insert black data between two neighboring first field data among the plurality of first field data of one line unit so as to generate first output data divide the plurality of second field data into a plurality of line units;

insert black data between two neighboring second field data among the plurality of second field data of one of the plurality of line units so as to generate second output data; and a data driver configured to transmit a first data signal according to the first output data to the display panel in the first field and transmit a second data signal according to the second output data to the display panel in the second field.

2. The display device of claim 1, wherein the plurality of first pixels and the plurality of second pixels are alternately disposed as at least one pixel unit in one predetermined direction.

3. The display device of claim 1, wherein the plurality of first pixels and the plurality of second pixels are alternately disposed as at least one pixel unit in one predetermined direction, and wherein the added black data of the first output data is transmitted to the plurality of second pixels, and the added black data of the second output data is transmitted to the plurality of first pixels.

4. The display device of claim 1, wherein the plurality of first pixels and the plurality of second pixels are continuous along the one predetermined direction.

5. The display device of claim 1, wherein the display device further includes a scan driver configured to sequentially supply a corresponding scan signal to a plurality of scan lines connected to the plurality of pixels according to the pixel line to activate driving of each pixel.

6. The display device of claim 1, wherein the plurality of first field data to be transmitted to the plurality of first pixels corresponding to the same pixel column are the same color data, and the plurality of second field data to be transmitted to a plurality of second pixels corresponding to the same pixel column are the same color data.

7. The display device of claim 6, wherein each of a one direction arranging sequence of the first field data and the second field data is a sequence of a first color, a second color, and a third color.

8. The display device of claim 1, wherein the color pattern of the first field data and the second field data is a pattern in which different colors are crossed.

9. The display device of claim 8, wherein the first field data includes a first color data, a second color data, and a third color data that are sequentially repeatedly applied to the plurality of first pixels in odd-numbered pixel columns as the same color data, and includes the black data applied to the plurality of second pixels in even-numbered pixel columns.

10. The display device of claim 8, wherein the second field data includes a first color data, a second color data and a third color data that are sequentially repeatedly applied to the plurality of second pixels which are in the even-numbered pixel columns as the same color data, and includes the black data applied to the plurality of first pixels which are in the odd-numbered pixel columns.

11. The display device of claim 1, wherein when the input data corresponds to a 1×1 dot pattern including a white image and a black image that are crossed and displayed in a first direction and a second direction perpendicular to each other, a distribution ratio between the colors in the image displayed by the first output data and a distribution ratio between the colors in the image displayed by the second output data are equal to each other.

12. The display device of claim 1, wherein when the input data corresponds to a 1×1 dot pattern including a white image and a black image that are crossed and displayed in a first direction and a second direction perpendicular to each other, predetermined color distribution ratios of the images displayed by the first output data and the second output data are equal to each other.

13. The display device of claim 12, wherein the predetermined color distribution ratio is a distribution ratio of the color data of the highest luminance in the first field and the second field.

14. The display device of claim 13, wherein the color data of the highest luminance corresponds to green data.

15. A display device comprising:

a display panel including a plurality of pixels including a plurality of first light emitting elements emitting light in a first field and a plurality of second light emitting elements emitting light in a second field;

a controller configured to extract from input data a plurality of first field data to be transmitted to the plurality of first light emitting elements in the first field and a plurality of second field data to be transmitted to the plurality of second light emitting elements in the second field; and a data driver configured to transmit a first data signal according to the plurality of first field data to the display panel in the first field and transmit a second data signal according to the plurality of second field data to the display panel in the second field, wherein the plurality of first field data are respectively transmitted to the plurality of first light emitting elements included in three pixels of a first line that are continuous along one direction such that at least three color data corresponding to light of different colors are repeatedly arranged; and the plurality of second field data are respectively transmitted to the plurality of second light emitting elements included in three pixels of a second line that are continuous along one direction such that at least three color data corresponding to the light of different colors are repeatedly arranged.

16. The display device of claim 15, wherein one of the plurality of first light emitting elements included in one pixel emits the light in the first field according to corresponding data from the first data signal;

one of the plurality of the second light emitting elements included in one pixel emits the light during the second frame according to the second data signal ; and the first light emitting element and the second light emitting element emit light of different colors.

17. The display device of claim 15, wherein the plurality of first field data transmitted to the plurality of first light emitting elements included in a plurality of pixels corresponding to the same pixel column are the same color data, and the plurality of second field data transmitted to the plurality of second light emitting elements included in a plurality of pixels corresponding to the same pixel column are the same color data.

18. The display device of claim 15, wherein an arranging sequence of the color emitted by the plurality of first light emitting elements included in three continuous pixels corresponding to the same pixel line is a sequence of the first color, the second color, the third color, and an arranging sequence of the color emitted by the plurality of second light emitting elements included in three continuous pixels corresponding to the same pixel line is a sequence of the first color, the second color, and the third color.

19. The display device of claim 15, wherein the plurality of first field data includes first color data, third color data, and plurality of second color data sequentially applied to the plurality of first light emitting elements included in three pixels that are continuous along one direction, and the plurality of second field data includes the second color data, the first color data, and the third color data sequentially applied to the plurality of second light emitting elements included in three pixels continuous along one direction.

20. The display device of claim 15, wherein the display device further includes a scan driver configured to sequentially supply a corresponding scan signal to a plurality of scan lines connected to the plurality of pixels according to the pixel line so as to activate driving of each pixel.

21. The display device of claim 15, wherein the plurality of pixels respectively include a first light emission control transistor configured to control light emission of the first light emitting element and a second light emission control transistor configured to control light emission of the second light emitting element, and the first light emission control line is connected to a gate electrode of each first light emission control transistor of a plurality of pixels, and the second light emission control line is connected to a gate electrode of each second light emission control transistor.

22. The display device of claim 21, wherein each of the plurality of first light emitting elements of the plurality of pixels emits light in response to the first light emission control signal transmitted through the first light emission control line in the first field of one frame, and each of the plurality of second light emitting elements of the plurality of pixels emits light in response to the second light emission control signal transmitted through the second light emission control line in the second field of one frame.

23. The display device of claim 15, wherein the display device further includes:

a light emission driver configured to sequentially supply a first light emission control signal for controlling the light emitting of the plurality of first light emitting elements in the first field, and a second light emission control signal for controlling the light emitting of the plurality of second light emitting elements in the second field to a plurality of first light emission control lines, and a plurality of second light emission control lines connected to the plurality of pixels according to the pixel line.

24. The display device of claim 23, wherein the first light emission control signal and the second light emission control signal have a reverse voltage phase, and the voltage phase of the first light emission control signal and the second light emission control signal are crossed and converted in the first field and the second field.

25. The display device of claim 15, wherein when the input data has a 1×1 dot pattern including a white image and a black image that are crossed and displayed in a first direction and a second direction perpendicular to each other, a distribution ratio between the colors in the image displayed by the plurality of first field data and the plurality of second field data is equal to each other.

26. The display device of claim 15, wherein when the input data has a 1×1 dot pattern including a white image and a black image that are crossed and displayed in a first direction and a second direction perpendicular to each other, predetermined color distribution ratios of the image displayed by the first output data and the second output data are equal to each other.

27. The display device of claim 26, wherein the predetermined color distribution ratio is the distribution ratio of the color data of the highest luminance in the first field and the second field.

28. The display device of claim 27, wherein the color data of the highest luminance corresponds to green data.

29. A method of arranging image data of a display device in which one frame is driven in a first field and a second field, the method comprising:

storing input data to a data memory;

dividing the stored input data into a plurality of first field data to be transmitted to a plurality of first elements emitting light in the first field and a plurality of second field data to be transmitted to a plurality of second elements emitting light in the second field;

generating first output data according to the plurality of first field data and generating second output data according to the plurality of second field data;

transmitting a first data signal based on the first output data to the plurality of first elements in the first field; and transmitting a second data signal based on the second output data to the plurality of second elements in the second field.

30. The method of claim 29, further comprising:

dividing the plurality of first field data into a plurality of line units;

inserting black data between two neighboring first field data among the plurality of first field data of one line unit;

dividing the plurality of second field data into a plurality of line units; and inserting black data between two neighboring second field data among the plurality of second field data of one line unit.

31. The method of claim 29, wherein the plurality of first elements and the plurality of second elements are alternately disposed to correspond to at least one element unit along one predetermined direction.

32. The method of claim 31, wherein the arranging sequence of a color that is emitted by the plurality of first elements and the plurality of second elements that are alternately disposed is a sequence of a first color, a second color, and a third color.

33. The method of claim 29, wherein a color pattern of the plurality of first field data and the plurality of second field data transmitted to the plurality of first elements and the plurality of second elements is a pattern in which different colors are crossed.

34. The method of claim 29, wherein the plurality of first field data transmitted to the plurality of first elements corresponding to the same column are the same color data, and wherein the plurality of second field data transmitted to the plurality of second elements corresponding to the same column correspond to the same color data.

35. The method of claim 29, wherein when the input data corresponds to a 1×1 dot pattern such that a white image and a black image are crossed and displayed in a first direction and a second direction perpendicular to each other, predetermined color distribution ratios of images displayed by the first output data and the second output data are equal to each other.

* * * * *